US006442792B1

(12) United States Patent
Sudou et al.

(10) Patent No.: US 6,442,792 B1
(45) Date of Patent: Sep. 3, 2002

(54) VACUUM CLEANER

(75) Inventors: Takayuki Sudou; Ryuji Ikeda, both of Hitachi; Susumu Sato, Takahagi; Shigenori Sato, Nihari; Taiji Tajima, Tsukuba; Shoji Hayashi, Niihari; Sadashi Tanaka, Niihari; Kazuyuki Sugimura, Niihari; Fumio Jyoraku, Hitachiota, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/492,082

(22) Filed: Jan. 27, 2000

(30) Foreign Application Priority Data

Jan. 29, 1999 (JP) ..... 11-021269
Jan. 29, 1999 (JP) ..... 11-021270
Jul. 6, 1999 (JP) ..... 11-191212

(51) Int. Cl.[7] ..... A47L 5/00
(52) U.S. Cl. ..... 15/339; 15/352; 15/410; 15/DIG. 1
(58) Field of Search ..... 15/347, 352, 351, 15/339, 410

(56) References Cited

U.S. PATENT DOCUMENTS 3,184,775 A * 5/1965 Downey et al. ..... 15/377 X
5,014,388 A * 5/1991 Schiazza et al. ..... 15/DIG. 1
5,500,979 A * 3/1996 Worwag ..... 15/352 X
5,603,139 A * 2/1997 Alaze ..... 15/350 X
5,617,611 A * 4/1997 Worwag ..... 15/352 X
5,659,922 A * 8/1997 Louis ..... 15/352 X
5,664,285 A * 9/1997 Melito et al. ..... 15/352
5,839,158 A * 11/1998 Schupp et al. ..... 15/350
6,012,200 A * 1/2000 Murphy et al. ..... 15/352 X

FOREIGN PATENT DOCUMENTS

JP 50-64201 6/1975
JP 61-101698 6/1986

* cited by examiner

*Primary Examiner*—Chris K. Moore
(74) *Attorney, Agent, or Firm*—Antonelli, Terry, Stout & Kraus, LLP

(57) ABSTRACT

A vacuum cleaner includes a vacuum cleaner body in which a rotating brush, a dust collecting unit and an electric blower unit are integrally attached to a suction opening casing in which a brush chamber is formed. A rodlike handle is connected to the vacuum cleaner body. The rodlike handle is formed by a hollow member, and a plurality of batteries are arranged in series in the hollow member and are covered with a heat contraction tube.

23 Claims, 23 Drawing Sheets

FIG. 14A
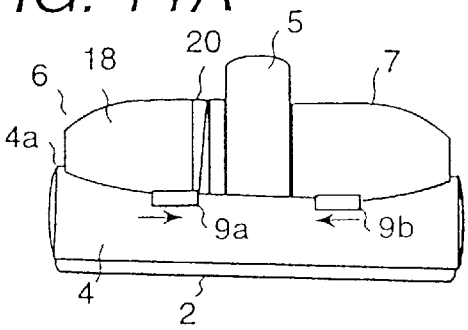
FIG. 14B
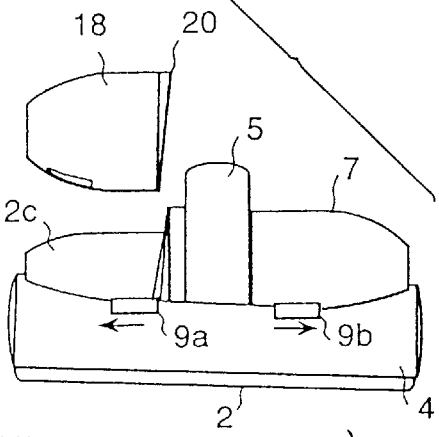
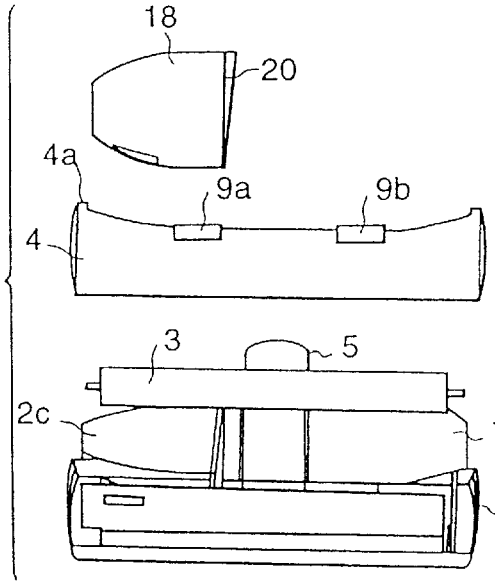
FIG. 14D
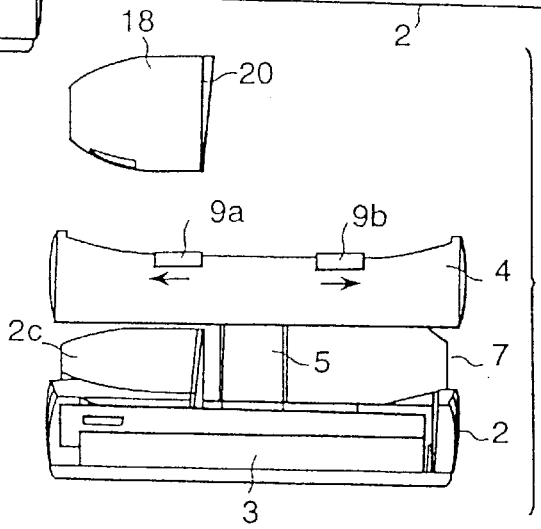
FIG. 14C 10a
10b
10c 10d
10e
10b
10c 8c
10h
8b
10e
10g
10f
10b
10c
25a
8a
25

8c
10h
8b
10g
10e
8d
8a
25a
10f
10b
10c
25

VACUUM CLEANER

BACKGROUND OF THE INVENTION

1. Field of the Invention

The present invention relates to a vacuum cleaner and, more particularly, to a cordless vacuum cleaner using an internal battery as a power source.

2. Related Background Art

The basic construction of a vacuum cleaner is generally such that a suction force of an electric blower is allowed to act on a suction opening facing a floor to be cleaned, air including dust sucked through the suction opening is passed to a dust collecting unit, and dust is collected and removed by a dust collecting filter. The collected dust is accumulated in the dust collecting unit. A rotating brush which slides on the floor is mounted at the suction opening to stir up dust on or hiding in the floor, thereby increasing the dust sucking efficiency. The dust collecting unit is detachable so that the accumulated dust can be discarded and the dust collecting filter cleaned or replaced.

When the suction opening is lifted and is apart from the floor, the rotating brush rotates in idle at high speed, and it makes noises and is also dangerous. Consequently, a safety switch for detecting that the suction opening is apart from the floor face and stopping the rotation of the rotating brush has been proposed.

A cordless vacuum cleaner using an internal battery as a power source has been proposed, with a rodlike handle attached to the body of the vacuum cleaner. The body includes a rotating brush, a dust collecting unit and an electric blower unit which are integrally attached to a suction base in which a brush chamber is formed to reduce the size and weight for easy use.

In such a small vacuum cleaner, since the dust collecting unit has a small size, the volume of the dust collecting box is small, and the area of the dust collecting filter is also small. Since it therefore becomes necessary to relatively frequently discard dust accumulated in the dust collecting box and clean the dust collecting filter, it is desirable that attaching and detaching operations of the dust collecting box be easy. Moreover, in the attached state, it is desirable that any air duct joint is sufficiently airtight, and that resistance to the ventilating air flow is low.

Since waste thread, hair and the like twine around the rotating brush, the rotating brush has to be taken out to remove them. It is therefore also desirable that the rotating brush can be easily exposed or attached/detached.

It is also desirable that dust collected by the dust collecting filter can be efficiently accumulated in a small dust collecting box.

If the capacity of a battery in such a vacuum cleaner is increased so as to permit continuous long-time use, the vacuum cleaner becomes large and heavy, and its operability or handling becomes difficult.

On the other hand, Japanese Unexamined Utility Model Publication No. 61-101698 discloses an electric blower.

The electric blower has a skirt for changing the direction of fluid flowing in the radial direction from the center of an impeller fixed to a motor shaft to the axial direction of the motor shaft. The skirt is on the periphery of the impeller.

By the structure, the direction of air flowing out from the periphery of the impeller can be changed to the axial direction in the impeller. The size of the impeller can be therefore increased with respect to a fan cover of the same size. For obtaining the same characteristics, therefore, the rotational speed can be reduced and the noise level, influenced mainly by the rotational speed, is accordingly suppressed.

Japanese Unexamined Utility Model Publication No. 50-64201 discloses a technique for improving the efficiency of a submergible motor pump.

The submergible motor pump has a pump casing formed in an angular shape in cross section. A volute discharge opening of the pump is disposed in the apex portion of the angular shape. A circular motor casing is disposed substantially in contact with a side of the pump casing and the gap between the casings is extremely narrow.

Because of the structure, water discharged from the volute discharge opening reaches a pump discharge opening without interfering with the neighboring volute, so that friction loss and collision loss are reduced.

In a floor moving type or upright type vacuum cleaner, since the size of the body can be flexibly determined, the size and the rotational speed of the electric blower are easily set. The vacuum cleaner in which the size of the body is reduced and an electric blower having an electric motor and a blower and a dust collecting unit are provided in the body of the suction opening casing has, however, problems in that the outer, diameter of the blower cannot be increased and the rotational speed of the blower cannot be increased.

In the floor moving type or upright type vacuum cleaner, since the ventilating air loss in an area from the suction port to the inlet of the electric blower is large, in order to enhance the dust collectability, a high vacuum state has to be created. Consequently, a centrifugal impeller has to be used in the blower. This disturbs the miniaturization of the vacuum cleaner.

According to the conventional technique disclosed in Japanese Unexamined Utility Model Publication No. 61-101698, the outer diameter of the impeller is large and the size of the vacuum cleaner is large. This has a problem in that, when the volume of air is increased, the air is choked in a curve and the performance deteriorates.

Japanese Unexamined Utility Model Publication No. 50-64201, discloses a vacuum cleaner having an electric motor, a blower, and a dust collecting unit provided in the body of a sucking opening member. There is a large dead space in the suction opening member, so that the vacuum cleaner is large. When the air flowing from the blower is used to cool the electric motor in order to reduce the size of the vacuum cleaner, there is a problem in that the motor cannot be effectively cooled.

SUMMARY OF THE INVENTION

It is therefore a first object of the invention to provide a small, easy-to-use, high-performance vacuum cleaner.

A second object of the invention is to facilitate an operation of attaching/detaching a dust collecting box and an operation of attaching or exposing a rotating brush.

A third object of the invention is to maintain the air tightness at a joint portion of an air duct when the dust collecting box is attached.

A fourth object of the invention is to provide an air duct in which a ventilating air resistance is low.

A fifth object of the invention is to efficiently collect dust in a small dust collecting box.

A sixth object of the invention is to provide the body of a vacuum cleaner with a good weight balance.

A seventh object of the invention is to improve the handling of the vacuum cleaner by devising a form of housing for batteries, i.e., a power supply unit.

Specifically, a power supply unit is efficiently housed in a handle, assembling performance is improved, backlash in the handle is prevented, and deterioration in the operability due to the heavy weight of the power supply unit is prevented.

An eighth object of the invention is to provide a small, light and highly-efficient electric blower in a vacuum cleaner having a structure such that the electric blower, comprising an electric motor and a blower, and a dust collecting unit are provided in the body of a suction opening member, providing a small, light vacuum cleaner having high dust collectability.

According to the invention, there is provided a vacuum cleaner having a body integrating a rotating brush, a dust collecting unit and an electric blower unit with a suction opening casing in which a brush chamber is formed. The brush chamber can be covered with a suction opening cover on the front side portion, in front of a partition wall provided upright in the rear portion of a suction opening. The rotating brush is housed in the brush chamber, and the dust collecting unit and the electric blower unit are arranged in the lateral direction in the rear portion. The rotating brush is rotated by a driving motor in the electric blower unit. The dust collecting unit has a cup-shaped dust collecting box having a suction opening in a side face and a dust collecting filter housed in the dust collecting box. The dust collecting box can be detachably attached to the suction opening casing so as to lie down by using a dust collecting unit receiver provided upright at the rear end of the suction opening casing as a support. The suction opening of the attached dust collecting box is securely communicated with the rear end of a suction duct which is formed in the partition wall and is opened to the brush chamber. The opening end of the dust collecting box is securely communicated with the communication passage to the electric blower unit. Thus, by having this arrangement of the components, the small, easy-to-use, high-efficient vacuum cleaner is provided.

The suction opening cover has a control knob for a retaining mechanism for retaining the dust collecting box and the suction opening cover on the suction opening casing. This makes the attaching/detaching operation of the dust collecting box and the suction opening cover easy. The collected dust in the dust collecting unit can be discarded, and the rotating brush can be exposed or detached to be cleaned.

In the dust collecting unit, a step is formed on the peripheral face of the dust collecting box and comes into contact with a step in the suction opening casing in order to stabilize the dust collecting box in an attaching position when the operation of attaching the dust collecting box is performed in the vertical direction.

The dust collecting box in the dust collecting unit is formed in a cup shape having a side face inclined so that the bottom has a small diameter, and the suction opening is formed in the inclined side face.

The suction opening is in the lower half portion when the dust collecting box is attached.

The dust collecting unit is constructed so that the dust collecting box is attached/detached in the vertical direction. A packing is attached to the end face of the opening of the dust collecting box with an inclined face whose upper side is thick and whose lower side is thin and recedes. An end face of the communication passage is formed as a flange having an inclined face whose lower side is thick and whose upper side is thin and recedes.

By such specific construction, the air tightness at the joint of the air ventilating duct is not lost when the duct collecting box is attached, and an air ventilating duct in which resistance to ventilating air is low is provided.

In the dust collecting unit, the dust collecting filter is housed eccentrically in the dust collecting box.

Specifically, the dust collecting filter is housed eccentrically so as to be close to the suction opening of the dust collecting box or so as to be apart from the suction opening, thereby efficiently collecting dust into the small dust collecting box.

By providing a handle joint swingable so as to surround the communication passage provided between the dust collecting unit and the electric blower unit, a good weight balance of the vacuum cleaner body is obtained.

Further, according to the invention, a vacuum cleaner is provided comprising: a vacuum cleaner body in which a rotating brush, a dust collecting unit, and an electric blower unit are integrally attached in a suction opening casing in which a brush chamber is formed; and a rodlike handle connected to the vacuum cleaner body, the rodlike handle being constructed by a hollow member, and a plurality of batteries are housed in series in the hollow member, thereby efficiently housing the power supply unit.

The plurality of batteries are covered with a heat contraction tube so as to be integrated in a rodlike member and housed in the hollow member, thereby improving the assembling performance.

Further, an arbitrary number of backlash preventing packings, which are elastically made by using a foamed resin, are interposed between the rodlike member and the hollow member, and each of the outer ends of the plurality of batteries arranged in series is pressed via a protection packing, thereby preventing the batteries from rattling in the handle.

The dust collecting unit and the electric blower unit are arranged in the lateral direction on the back side of the brush chamber in the suction opening casing and are connected to each other via a communication passage. A handle joint is provided so as to surround the communication passage, and the rodlike handle is connected to the handle joint, thereby preventing the operation from becoming unstable due to the weight of the batteries.

BRIEF DESCRIPTION OF THE DRAWINGS

FIGS. 1A to 1D are diagrams each showing an external view of a cordless vacuum cleaner according to the invention, with the handle folded down, in which FIG. 1A is a plan view. FIG. 1B is a side view, FIG. 1C is a front view, and FIG. 1D is a cross section taken along line A—A of FIG. 1A.

FIG. 14A is a perspective view showing the dust collecting box and the suction opening cover set in the suction opening casing of the body of the cordless vacuum cleaner shown in FIG. 1, FIG. 14B is a perspective view showing the dust collecting box detached, FIG. 14C is a perspective view showing the suction opening cover detached, and FIG. 14D is a perspective view showing the rotating brush detached.

DESCRIPTION OF THE PREFERRED EMBODIMENTS

Figure 1A:
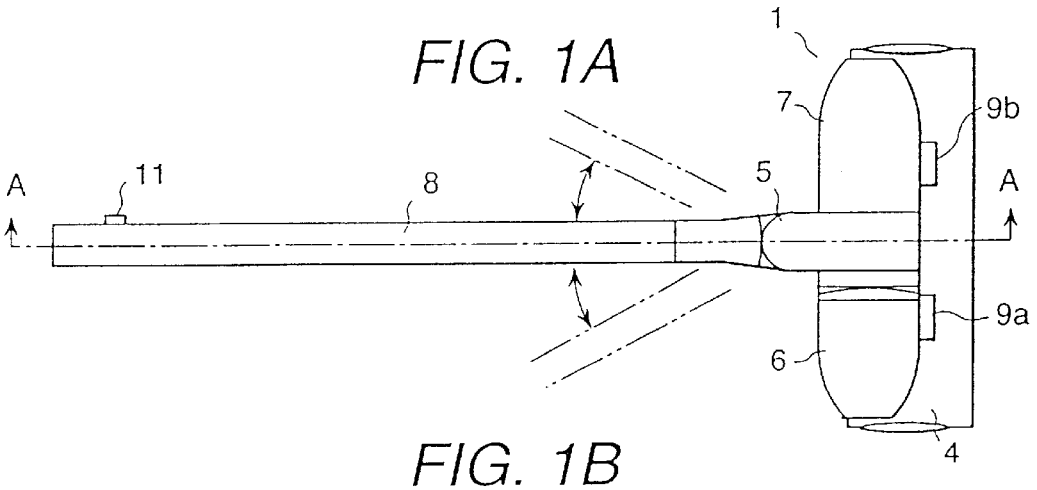
Figure 1B:
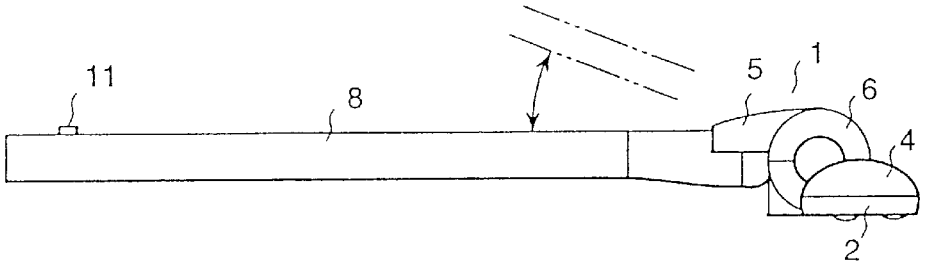
Figure 1C:
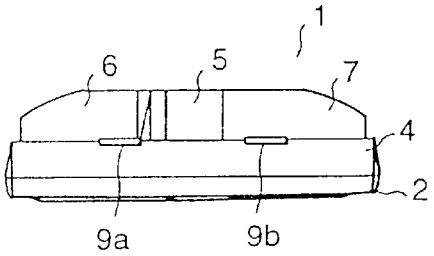
Figure 1D:
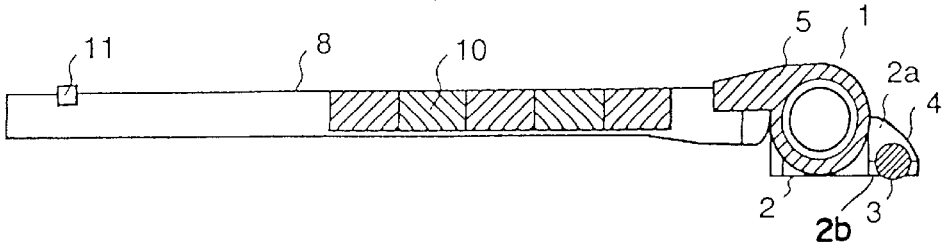
Figure 2:
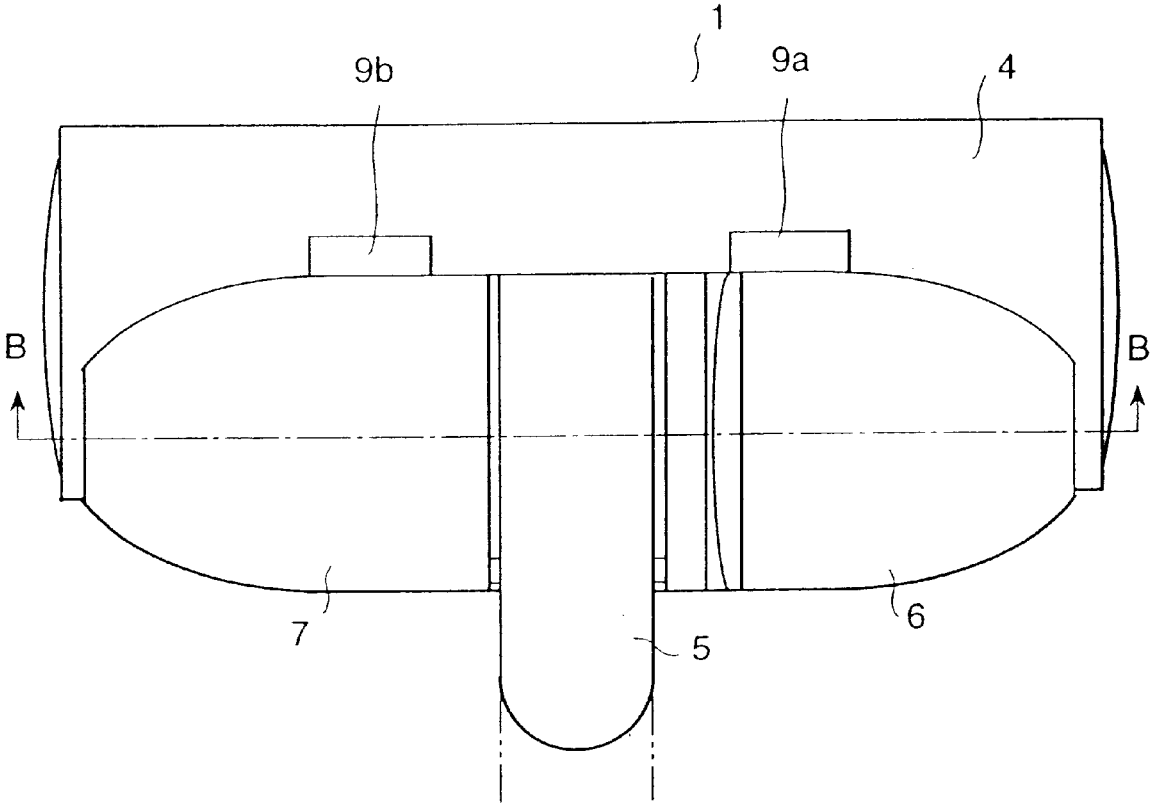
FIG. 2 is a top view of the vacuum cleaner body of the cordless vacuum cleaner shown in FIG. 1.
Figure 3:
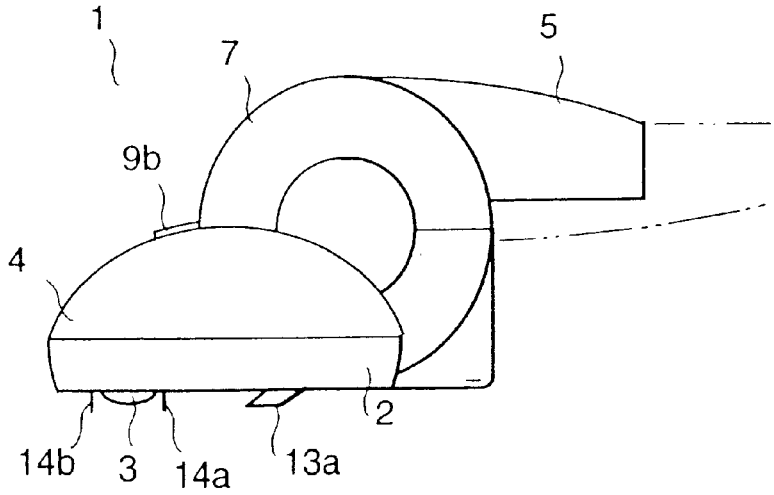
FIG. 3 is a side view of the vacuum cleaner body of the cordless vacuum cleaner shown in FIG. 1.
Figure 4:
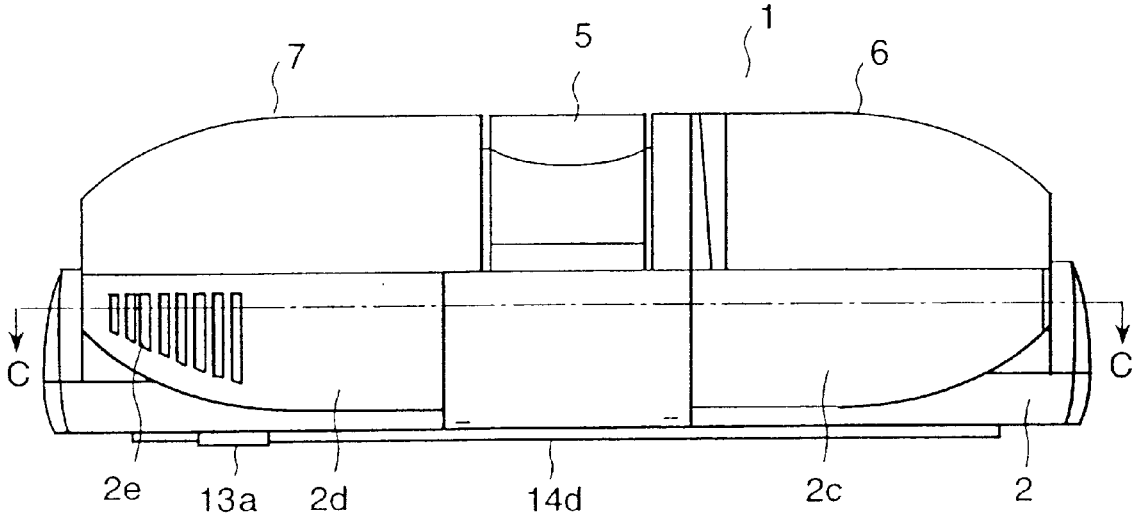
FIG. 4 is a back view of the vacuum cleaner body of the cordless vacuum cleaner shown in FIG. 1.
Figure 5:
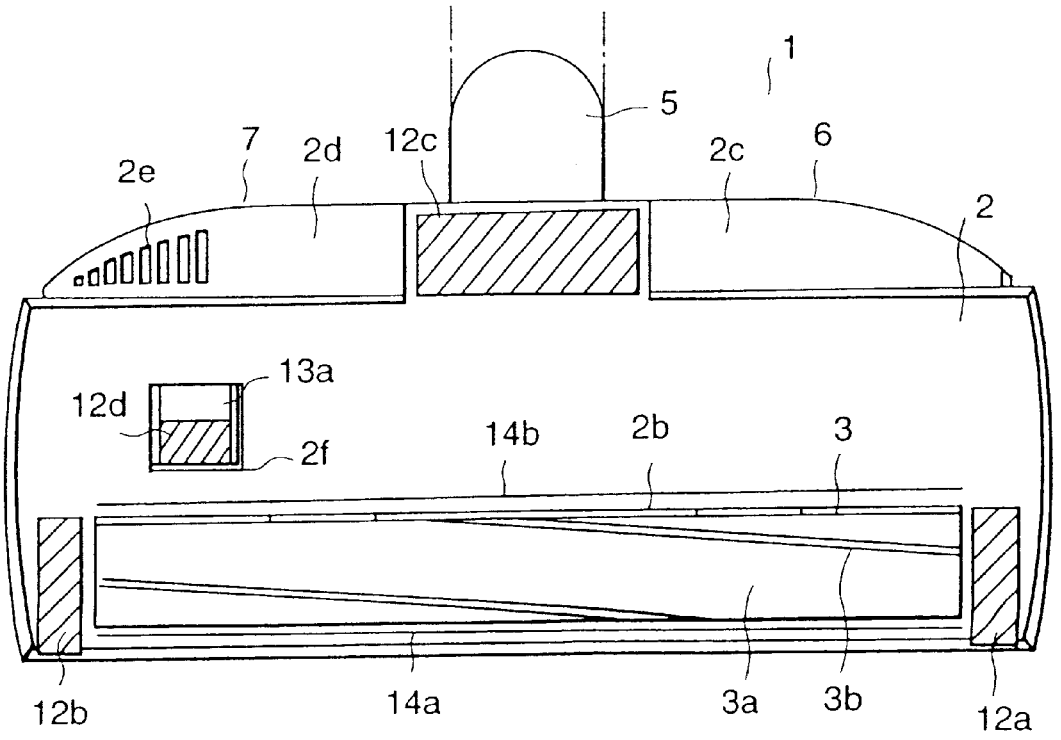
FIG. 5 is a bottom view of the vacuum cleaner body of the cordless vacuum cleaner shown in FIG. 1.
Figure 6:
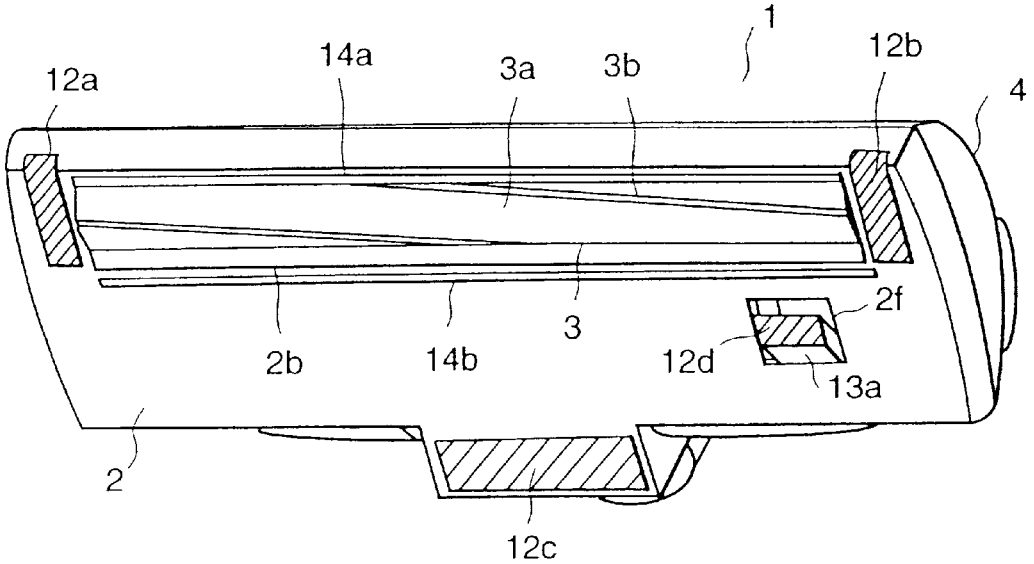
FIG. 6 is a bottom perspective view of the vacuum cleaner body of the cordless vacuum cleaner shown in FIG. 1.

An embodiment of the invention will be described herein below. FIGS. 1 to 6 show the external shape of a cordless vacuum cleaner as an embodiment of the invention. FIGS. 1A to 1D show the whole shape. FIG. 1A is a plan view with the vacuum cleaner handle folded down. FIG. 1B is a side view, FIG. 1C is a front view, and FIG. 1D is a cross section taken along line A—A of FIG. 1A. FIGS. 2 to 6 show the external shape of the vacuum cleaner body. FIG. 2 is a top view of the vacuum cleaner body. FIG. 3 is a side view, FIG. 4 is a back view, FIG. 5 is a bottom view, and FIG. 6 is a bottom perspective view.

In the body 1 of a cordless vacuum cleaner in the embodiment, a rotating brush 3 is rotatably housed in a wide brush chamber 2*a* formed in the front part of a suction opening casing 2, and a lower part of the rotating brush 3 is allowed to slightly project from a suction opening 2*b* to the outside. (FIG. 1D) The upper part of the brush chamber 2*a* is covered with a detachable suction opening cover 4. By detaching the suction opening cover 4, the upper side of the brush chamber 2*a* is opened to thereby expose and detach or attach the rotating brush 3.

In the rotating brush 3, a plurality thin, elongated hair bundles 3*b* (FIGS. 5,6), made of nylon or the like or hair of an animal such as a pig, are spirally provided around a rotary shaft 3*a*. The spacing between the neighboring hair bundles 3*b* is greater toward the side of a suction duct (which will be described hereinafter) which opens at the end on the dust collecting unit side of the brush chamber 2*a* so as to facilitate air containing dust in the brush chamber 2*a* being evenly sucked to the suction duct. Specifically, such a rotating brush 3 is provided by sequentially changing the spiral pitch of the hair bundles 3*b* so as to be low on the suction duct side. In such a manner, an air passage in the brush chamber 2*a* is widened on the suction duct side where the flow rate of the air is high and the ventilating air resistance becomes low. On the suction duct side where the flow rate of the air is low, the hair bundles 3*b* are more dense so that the force of sliding on the floor can be enhanced.

The hair bundles 3*b* are subjected to water repellent finishing so as to be water proof.

On the rear side of the suction opening casing 2, a handle joint 5 is provided, which is positioned in the center in the width direction and which can swing from the horizontal state to the vertical state. On one of the sides in the width direction, a dust collecting unit 6 having therein a filter is provided. On the other side, an electric blower unit 7 is provided. A handle 8 is connected to the handle joint 5 so as to be swingable through 180 degrees in the lateral direction. The dust collecting unit 6 is detachably attached by using a dust collecting unit receiver 2*c* which stands at the rear end of the suction opening casing 2 as a part of a support. (FIG. 5) The electric blower unit 7 is attached by using an electric blower unit receiver 2*d* which stands at the rear end of the suction opening casing 2 as a part of a support. An exhaust opening 2*e* is formed in the electric blower unit receiver 2*d*.

The suction opening cover 4 and the dust collecting unit 6 are retained directly or indirectly on the suction opening casing 2 by a retaining mechanism. The retaining and release are carried out by control knobs 9*a* and 9*b* attached to the suction opening cover 4. (FIG. 1C) The details of the retaining mechanism will be described hereinafter.

In the handle 8, a power supply unit 10 in which five rechargeable batteries, connected in series, are housed to provide a power source for the electric blower. (FIG. 1D) The handle 8 has a control switch 11 at the hand part. The handle 8 in which the power supply unit 10 using the plurality of batteries is housed is relatively heavy. In the use state, where the handle 8 stands, the weight acts on the handle joint 5 positioned in the center part of the suction opening casing 2. The housing structure of the power supply unit 10 will be described hereinafter.

On the bottom of the suction opening casing 2, sliding members 12*a* and 12*b* are adhered to both sides of the suction opening 2*b* on the front end side, and a sliding member 12*c* is adhered to the center part in the width direction corresponding to the lower side of the handle joint 5 on the rear end side. (FIGS. 5,6) Below the electric blower unit 7 in the center in the travel direction of the bottom face of the suction opening casing 2, a safety switch exposing window 2*f* is provided. A lever 13*a* of a safety switch 13 (which will be described hereinafter) provided in the suction opening casing 2 projects from the safety switch exposing window 2*f*. The responding lever 13*a* is energized by a spring and projects from the safety switch exposing window 2*f*. When the bottom face of the suction opening casing 2 comes close to the floor, the responding lever 13*a* is pressed against the floor and is moved back. When the bottom face of the suction opening casing 2 travels so as to clean the floor, the end face of the responding lever 13*a* slides on the floor. Consequently, the end face is circularly formed so as to be easily slidable in the travel direction, and a sliding member 12*d* is also adhered to the end face. A responding switch detects the advance or retreat operation of the swing lever 13*a* and opens or closes an electric circuit. When the suction opening casing 2 is apart from the floor, the circuit for supplying power to the electric blower unit 7 is interrupted.

The sliding surface of each of the sliding members 12*a* to 12*d* is made of a pile material obtained by making a short soft and smooth fiber material such as nylon strand. Each of the sliding members 12*a* to 12*d* is adhered to its part by an adhesive applied on the back face so as to be slightly projected from the surface.

Each of the sliding members 12*a* and 12*b* on the two sides on the front end side of the bottom face of the suction opening casing 2 has a rectangular shape, elongated in the travel direction. The front end of each of the sliding members 12*a* and 12*b* extends so as to cover a portion of the front face of the suction opening casing 2. The rear ends of the sliding members 12*a* and 12*b* may be extended to the rear end of the bottom of the suction opening casing 2 or to the rear face. The sliding members 12*a* and 12*b* may be split into a plurality of parts in the travel direction.

The sliding member 12*c* in the center on the rear end side has a rectangular shape which is elongated in the width direction. The sliding member 12*d* on the end face of the responding lever 13*a* is formed so as to cover the whole end face.

At the front and rear peripheries of the suction opening 2*b*, pressure leakage preventing members 14*a* and 14*b* are provided, positioned closely along the periphery of the suction opening 2*b*. (FIGS. 5,6) Each of the pressure leakage preventing members 14*a* and 14*b* is either a brush, formed of an aggregate of a fiber material such as nylon, or a flexible thin plate piece made of soft chloroethylene or the like. When the suction opening is moved so as to clean the floor, the front end of each of the pressure leakage preventing members 14*a* and 14*b* comes into light touch with the floor.

Figure 7:
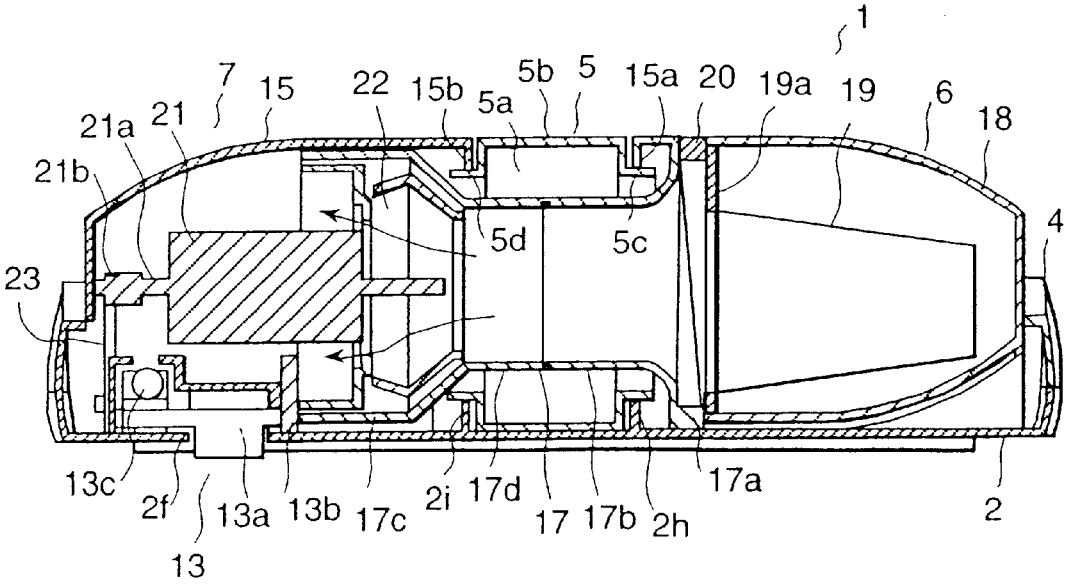
FIG. 7 is a cross section taken along line B—B of the vacuum cleaner body shown in FIG. 2.
Figure 8:
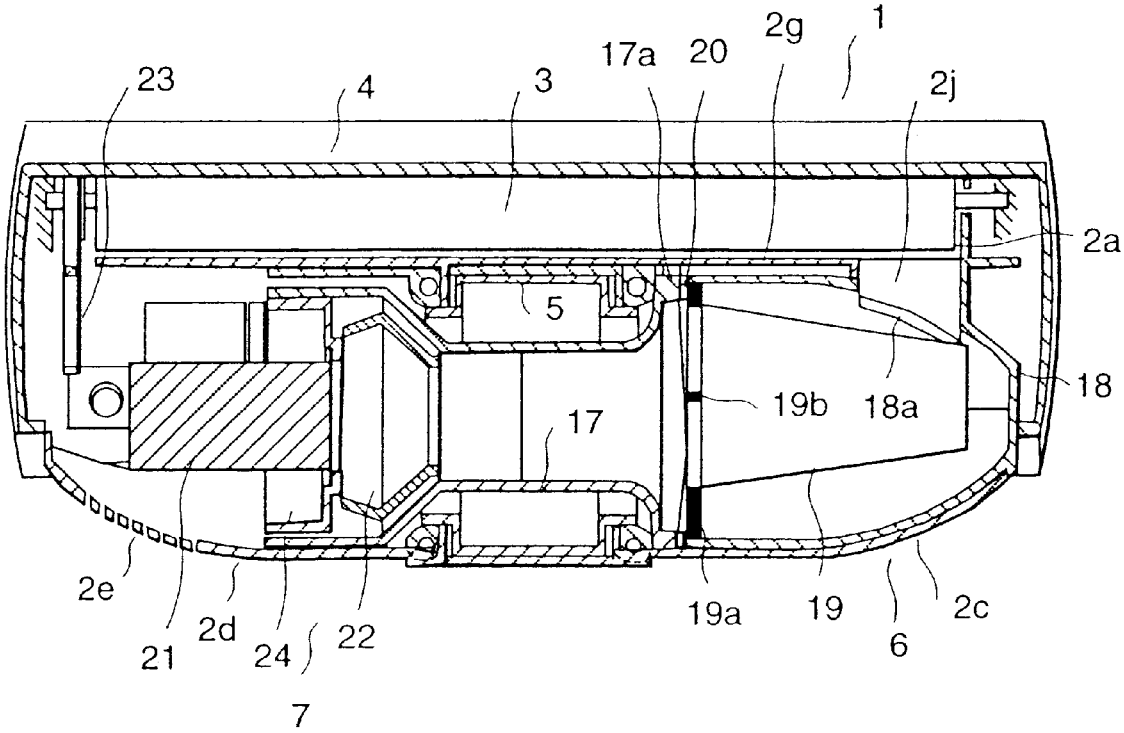
FIG. 8 is a cross section taken along line C—C of the vacuum cleaner body shown in FIG. 4.
Figure 9:
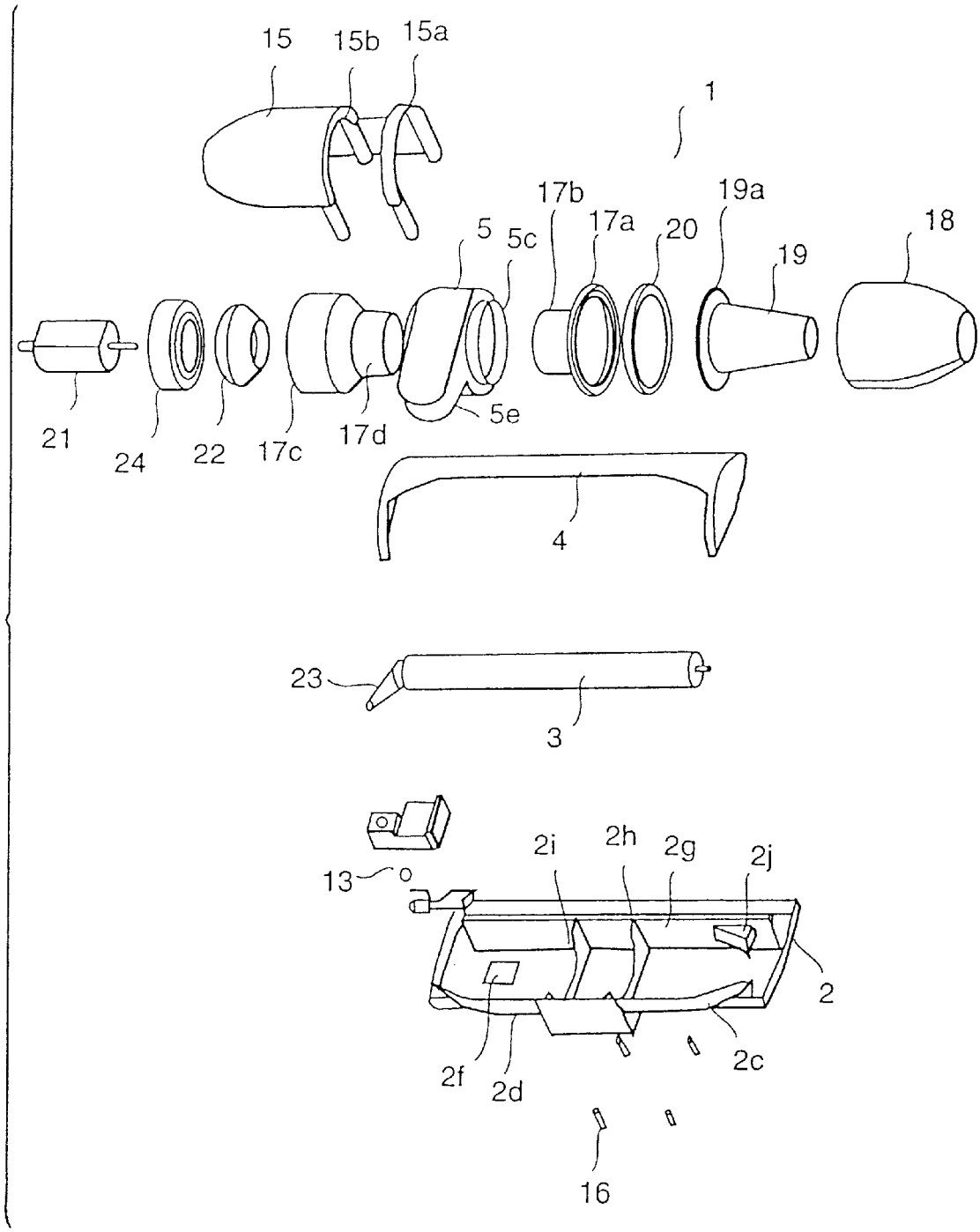
FIG. 9 is an exploded perspective view of the body of the cordless vacuum cleaner shown in FIG. 1.

FIGS. 7 to 9 show the internal construction of the vacuum cleaner body 1. FIG. 7 is a cross section taken along line B—B of FIG. 2. FIG. 8 is a cross section taken along line C—C of FIG. 4. FIG. 9 is an exploded perspective view.

The interior of the suction opening casing 2 is partitioned by a partition wall 2*g* extending vertically at the back of the suction opening 2*b*, dividing that interior into a front section and a rear section. (FIG. 8) The front section serves as the brush chamber 2*a* in which the rotating brush 3 is housed and which is covered with the suction opening cover 4 which is openable. In the rear section, the handle joint 5, the dust collecting unit 6 and the electric blower unit 7 are provided.

In the handle joint 5, circular sliding supports 5*c* and 5*d* are provided so as to project from both end faces of an annular base 5*b* in which a through hole 5*a* is formed. (FIG. 7) At the rear side of the periphery, a handle connecting part 5*e* which is connected to the handle 8 is provided. (FIG. 9) The sliding supports 5*c* and 5*d* of the handle joint 5 are positioned on semicircular supporting end faces of supporting ribs 2*h* and 2*i* that extend upwardly from the suction opening casing 2. Pressers 15*a* and 15*b*, each having a semicircular contact face, are formed in an electric blower unit cover 15 and contact the sliding supports 5*c* and 5*d* from overhead so as to swingably press the supports. In such a state, the electric blower unit cover 15 is attached to the suction opening casing 2 by set screws 16.

A ventilating air communication passage 17, having an almost cylindrical shape, is formed by inserting a dust collecting unit side passage member 17*b*, having a flange 17*a* at one end, and an electric blower unit side passage member 17*d*, having a blower housing unit 17*c* at one end, through a hole 5*a* in the handle joint 5. Members 17*b* and 17*d* are fitted together and bonded to each other in the through hole 5*a*. By attaching the ventilating air communication passage 17 to the suction opening casing 2, the ventilating air communication passage 17 is open on both sides of the handle joint 5.

The flange 17*a* of the ventilating air communication passage 17 is positioned so as to be open at the inner end in the width direction of the dust collecting unit 6 in the suction opening casing 2. The flange 17*a* is formed so that its lower side is thick and its upper side is thin, thereby providing an inclined face such that the upper side of the opening end face recedes.

The dust collecting unit 6 has within it a cup-shaped dust collecting box 18 with an open end. A cup-shaped dust collecting filter 19 is detachably housed within the opening of the dust collecting box 18. A flange 19*a*, provided around the periphery of the opening of the dust collecting filter 19, is detachably attached to the periphery of the opening of the dust collecting box 18. Further, a packing 20 is attached to the end face of the periphery of the opening of filter 19. Reference numeral 19*b* denotes a rodlike handle formed in the flange 19*a*. The packing 20 is formed so that the upper part is thick and the thickness is reduced toward the lower part, thereby forming a face inclined so that the lower part of the opening end face recedes. On one side of the dust collecting box 18, a suction opening 18*a* is provided. When the dust collecting box 18 is set in the suction opening casing 2, the periphery of the suction opening 18*a* is tightly in contact with the rear end face of the suction duct 2*j* which is formed in partition wall 2*g* of the suction opening casing 2 and so communicates with the brush chamber 2*a*, thereby forming a ventilating duct with no projected step.

The electric blower unit 7 has a centrifugal fan 22 driven by a motor 21. The centrifugal fan 22 is attached to the suction opening casing 2 and is positioned within the blower housing unit 17*c* in the ventilating air communication passage 17. A pulley 21*b* is attached to the end of the rotary shaft 21*a* of the driving motor 21, opposite the fan 22, and a belt 23 is looped over the pulley 21*b* so as to drive the rotating brush 3. Reference numeral 24 denotes a diffuser.

The safety switch 13 is attached to the suction opening casing 2 so as to be positioned below the driving motor 21. A responding lever 13*a* passes through the safety switch exposing window 2*f* projects from the suction opening casing 2. The advance/retreat of the responding lever 13*a* is detected by the responding switch 13*b* and the power supply circuit is opened/closed. The safety switch 13 is provided with a lock ball 13*c* which rolls to disturb the retreat of the responding lever 13*a* when the vacuum cleaner body 1 is turned on its back. The construction of the safety switch 13 is a known one.

The safety switch exposing window 2*f* may be positioned below the handle joint 5.

It is desirable that the attaching/detaching operation of the dust collecting box 18 in the dust collecting unit 6 be easy, and that even after the attaching/detaching operation, the air tightness of the joint in the ventilating duct be maintained and the ventilating air resistance in the ventilation duct be low.

Figure 10A:
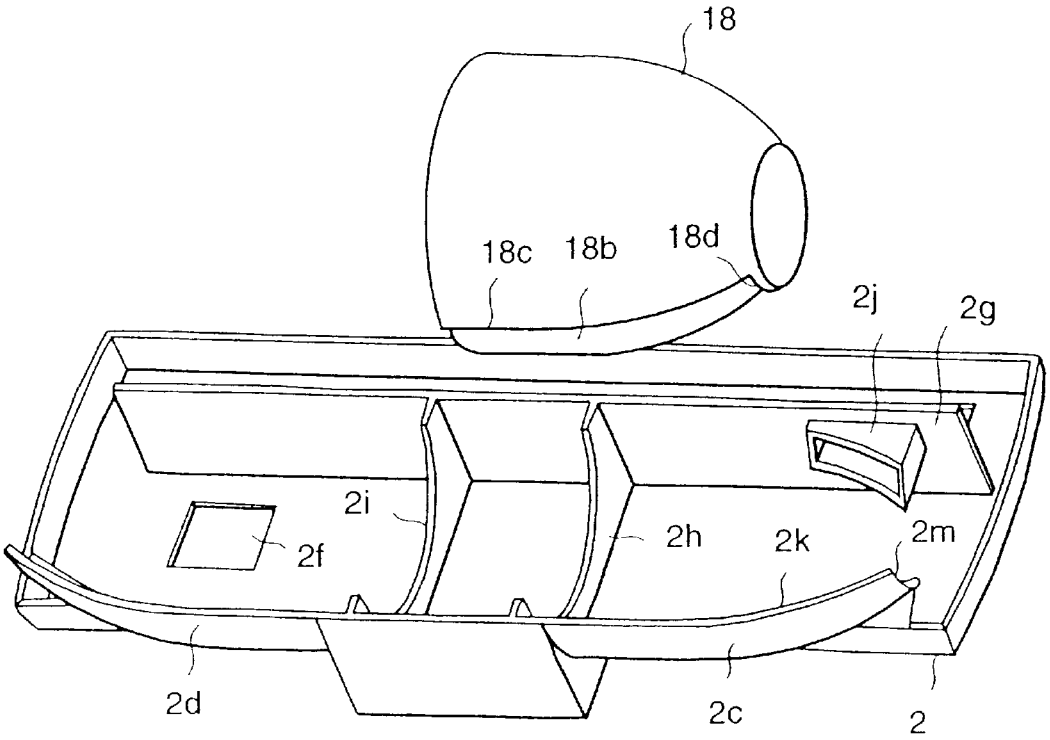
FIGS. 10A and 10B are a perspective view and a vertical sectional view showing a dust collecting box removed from a suction opening casing of the body of the cordless vacuum cleaner shown in FIG. 1.
Figure 10B:
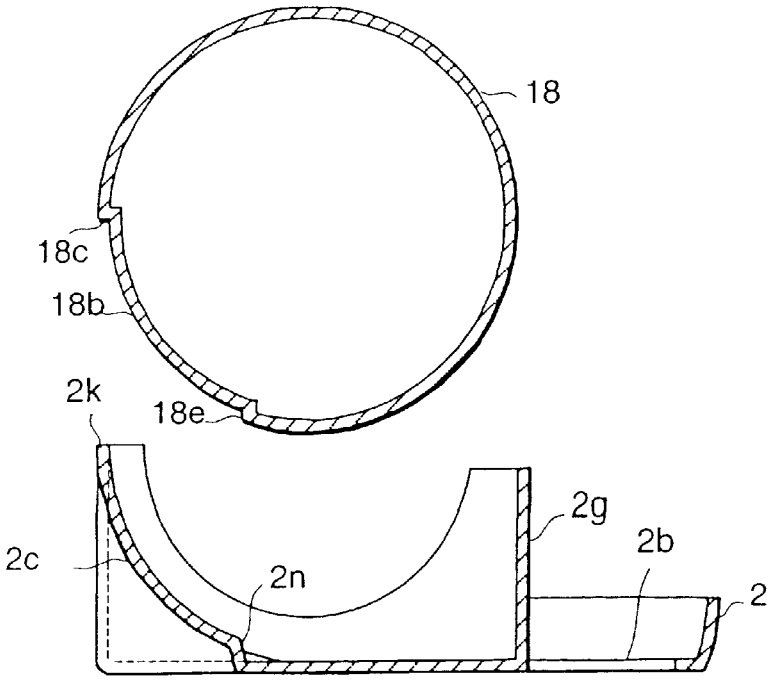
Figure 11A:
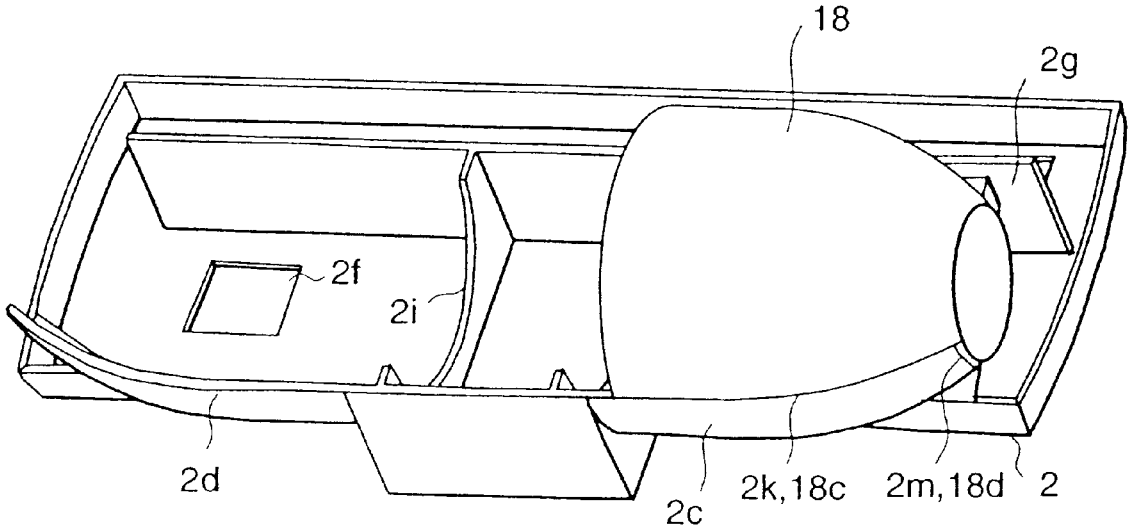
FIGS. 11A and 11B are a perspective view and a vertical sectional view showing the dust collecting box set in the suction opening casing of the body of the cordless vacuum cleaner shown in FIG. 1.
Figure 11B:
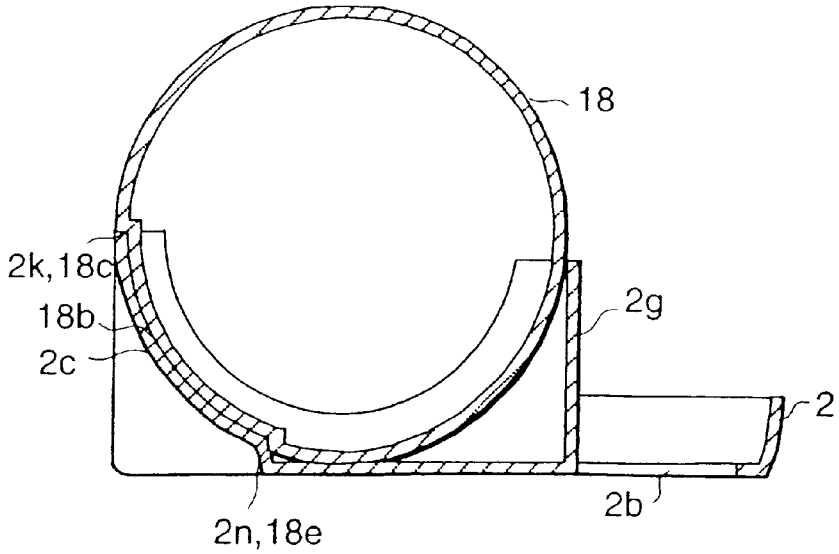

FIGS. 10 to 13 are diagrams showing the details of the dust collecting unit 6 which is constructed so as to accomplish the above. FIGS. 10 and 11 are diagrams showing a shape matching structure to enable the dust collecting box to be attached/detached in a correct posture to/from the suction opening casing. FIGS. 10A and 10B are a perspective view and a vertical section showing the suction opening casing and the dust collecting box separated from each other. FIGS. 11A and 11B are a perspective view and a vertical section showing the dust collecting box attached to the suction opening casing.

Figure 12A:
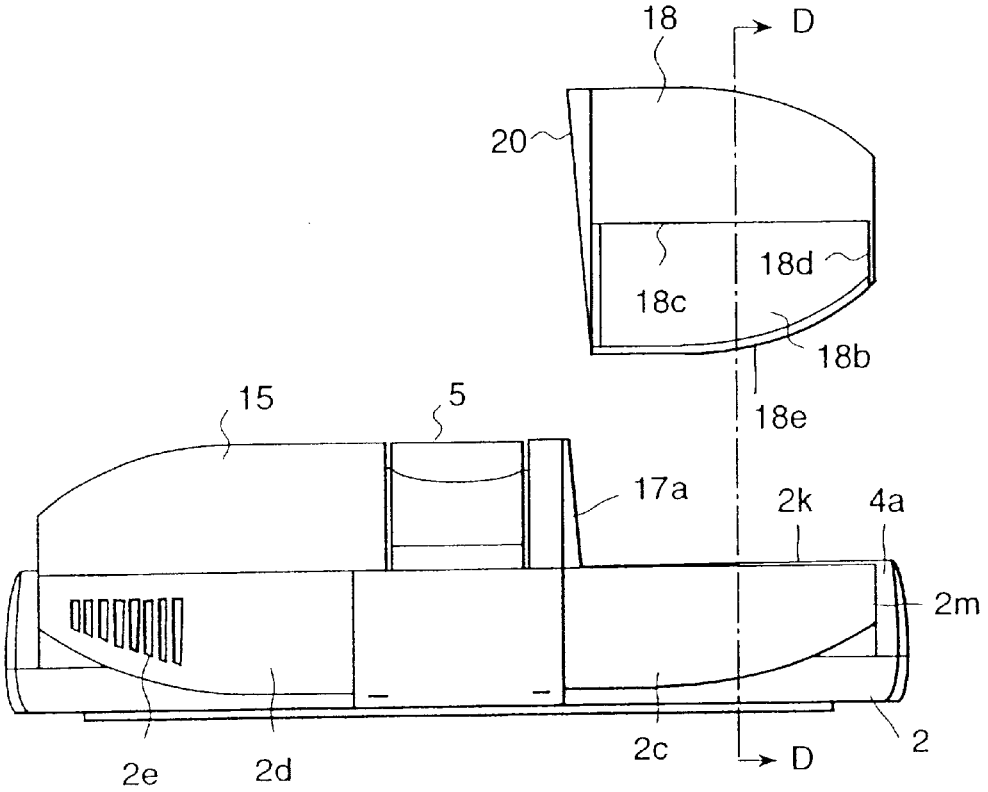
FIG. 12A is a back view showing the dust collecting box removed from the suction opening casing of the body of the cordless vacuum cleaner shown in FIG. 1.
Figure 12B:
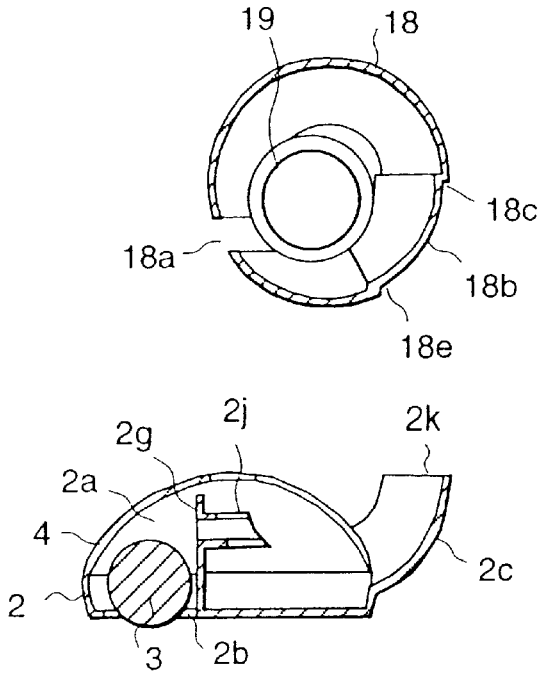
FIG. 12B is a cross section taken along line D—D of FIG. 12A.
Figure 13A:
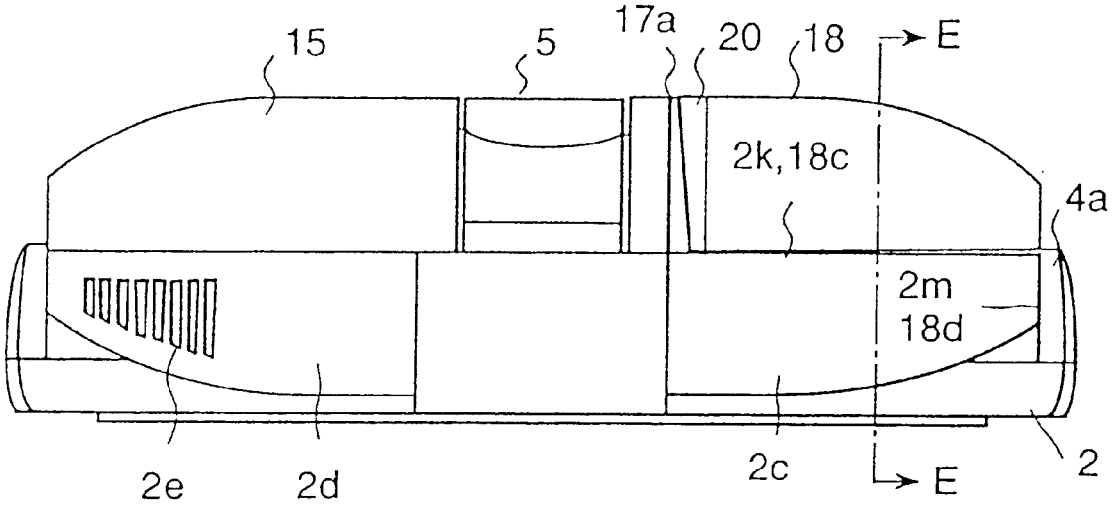
FIG. 13A is a back view showing the dust collecting box set in the suction opening casing of the body of the cordless vacuum cleaner shown in FIG. 1.
Figure 13B:
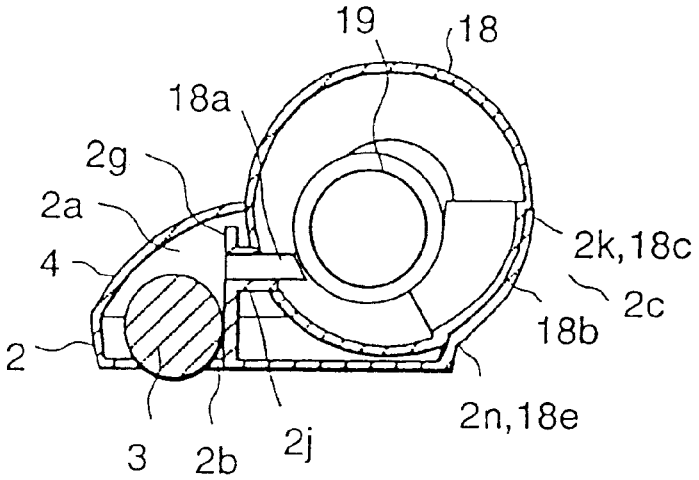
FIG. 13B is a cross section taken along line E—E of FIG. 13A.
Figure 16A:
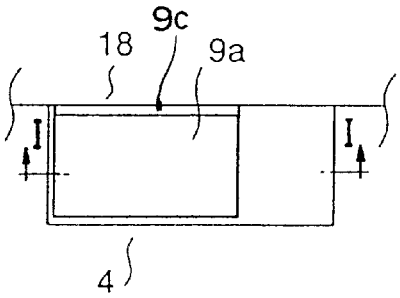
FIGS. 16A, 16B, 16C, and 16D are a plan view and vertical cross sections showing a released state of the retaining mechanism for the dust collecting box in the body of the cordless vacuum cleaner shown in FIG. 1, with FIG. 16B being taken along line I—I in FIG. 16A, FIG. 15C being taken along line J—J in FIG. 15B, and FIG. 16D being taken along line K—K in FIG. 16B.
Figure 16B:
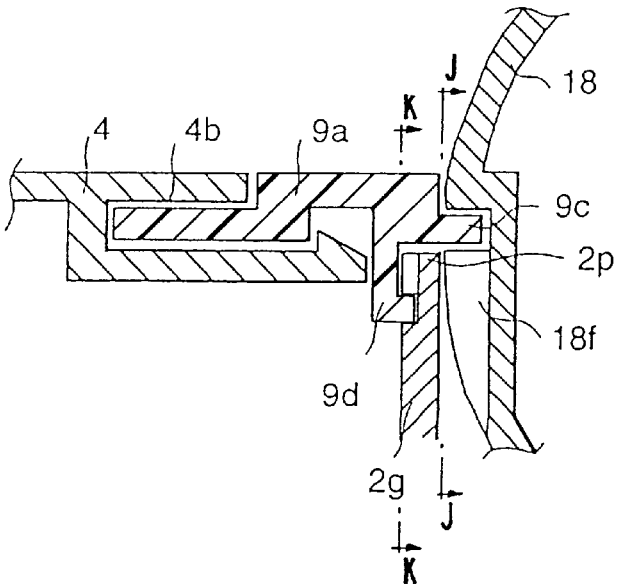

FIGS. 12 and 13 are diagrams showing the joint of the air duct when the dust collecting box is attached/detached to/from the suction opening casing. FIG. 12A is a back view showing the suction opening casing and the dust collecting box separated from each other. FIG. 12B is a cross section taken along line D—D of FIG. 12A. FIG. 13A is a back view showing the dust collecting box attached to the suction opening casing and FIG. 13B is a cross section taken along line E—E of FIG. 13A.

The dust collecting box receiver 2*c*, provided at the rear end of the suction opening casing 2, covers the lower half of the rear of the peripheral face of the dust collecting box 18. A recess 18*b*, into which the dust collecting box receiver 2*c* fits, is formed in the lower half of the rear side of the peripheral face of the dust collecting box 18. By making a front edge 2*k*, an outer edge 2*m* and a lower edge 2*n* of the dust collecting box receiver 2*c* come into contact with a step 18*c* at the upper end of the recess 18*b*, a step 18*d* at the outer end (end in the bottom direction), and a step 18*e* at the lower end, respectively, the dust collecting box 18 is positioned in a predetermined posture. When the dust collecting box 18 is attached to the suction opening casing 2, the peripheral faces of the dust collecting box 18 and the dust collecting box receiver 2*c* are flush with each other.

The dust collecting box 18 is easily attached/detached to/from the suction opening casing 2. When the dust collecting box 18 is attached in the suction opening casing 2, the suction opening 18*a* in the dust collecting box 18 communicates fully with the suction duct 2*j* formed in the partition wall 29, and the opening periphery communicates fully with the ventilating air communication passage 17.

The communication between the opening periphery of the dust collecting box 18 and the ventilating air communication passage 17 is made in an inclined face such that the upper side of the opening end face of the flange 17*a* of the ventilating air communication passage 17 recedes. (FIG. 7) The packing 20 attached to the periphery of the opening of the dust collecting box 18 has an inclined face whose lower side recedes. When the dust collecting box 18 is attached/detached in the vertical direction, the two inclined faces come into contact with or separate from each other with little friction.

The suction opening 18*a* of the dust collecting box 18 is in the lower half of the peripheral face near the bottom of the cup and is inclined obliquely downward. The front end periphery of the suction duct 2*j* is inclined obliquely upwardly so as to face the obliquely downwardly inclined surface of the dust collecting box 18 in which the suction opening 18*a* is positioned. The front end periphery of the suction duct 2*j* comes into contact with the peripheral face of the dust collecting box 18 so as to communicate with the suction opening 18*a* of the dust collecting box 18. In such a manner, the frictional amount of the contact faces at the time of attachment/detachment in reduced.

When the dust collecting box 18 is placed in the suction opening casing 2 from above, a component force to the inside is generated in the dust collecting box 18 by the contact of the dust collecting box 18 and the inclined face of the suction duct 2*j*. Consequently, the contact face pressure between the front end of the suction duct 2*j* and the periphery of the suction opening 18*a* and the contact face pressure of the packing 20 increase, so that the joint of the air duct becomes secure. The outer end face of the dust collecting box 18 is pressed by an end portion 4*a* extending rearward from the end of the suction opening cover 4. (FIGS. 12A, 13A)

FIGS. 14 to 18 show a retaining mechanism for attaching/detaching the dust collecting box 18 and the suction opening cover 4. FIG. 14A is a perspective view showing the dust collecting box 18 and the suction opening cover 4 attached to the suction opening casing 2, FIG. 14B is a perspective view showing the dust collecting box 18 detached, FIG. 14C is a perspective view showing the suction opening cover 4 detached, and FIG. 14D is a perspective view showing the rotating brush 3 detached. FIGS. 15 and 16 show a mechanism for retaining the dust collecting box 18. FIGS. 15A, 15B, 15C and 15D are a plan view and vertical cross sections showing a retained state. FIGS. 16A, 16B, 16C and 16D are a plan view and vertical cross sections showing a released state of the retaining mechanism. FIGS. 17 and 18 show a mechanism for retaining the suction opening cover 4. FIGS.

17A, 17B, 17C and 17D are a plan view and vertical cross sections showing a retained state of the retaining mechanism for the suction opening cover 4. FIGS. 18A, 18B, 18C and 18D are a plan view and vertical cross sections showing a released state of the retaining mechanism.

As shown in FIG. 14B, the dust collecting box 18 can be detached by controlling the control knob 9*a*. The suction opening cover 4 can be detached by controlling the control knobs 9*a* and 9*b* as shown in FIG. 14C. By detaching the suction opening cover 4, the upper side of the brush chamber 2*a* is opened, and the rotating brush 3 is exposed. As shown in FIG. 14D, the rotating brush 3 can be detached. It therefore enables dust collected in the dust collecting box 18 to be easily discarded and waste thread and hair twined around the rotating brush 3 to be easily removed.

As shown in FIGS. 15 and 16, the control knob 9*a* is fit in the guide groove 4*b* in the rear end portion of the suction opening cover 4 so as to be slidable in the width direction. A retaining portion 9*c*, extending to the dust collecting box 18 side, is positioned in a retaining groove 18*f* formed in a side face of the dust collecting box 18, and a retaining portion 9*d*, extending downward, is positioned in a retaining groove 2*p* formed in the partition wall 2*g*.

Figure 15A:
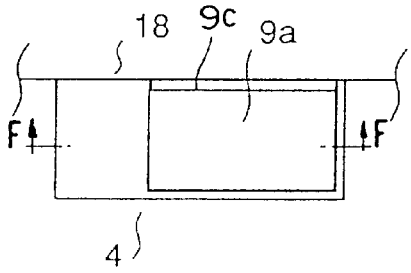
FIGS. 15A, 15B, 15C, and 15D are a plan view and vertical cross sections showing a retained state of a retaining mechanism for the dust collecting box in the body of the cordless vacuum cleaner shown in FIG. 1, with FIG. 15B being taken along line F—F in FIG. 15A, FIG. 15C being taken along line G—G in FIG. 15B, and FIG. 15D being taken along line H—H in FIG. 15B.
Figure 15B:
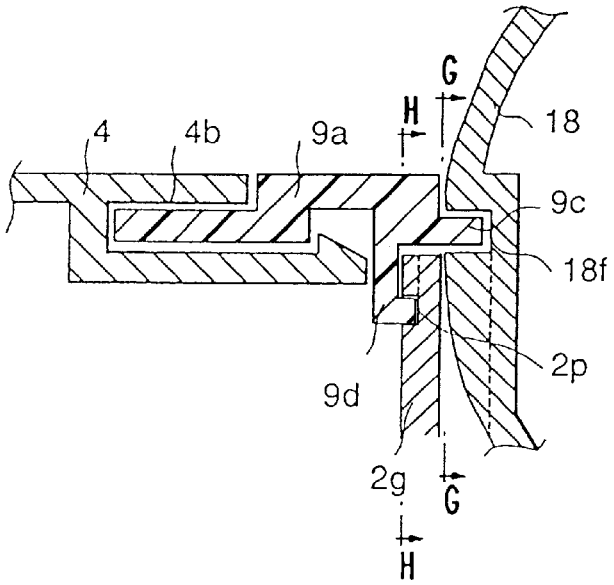
Figure 15C:
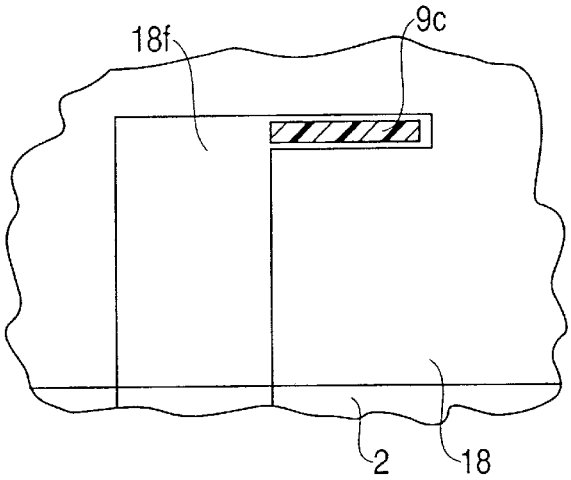
Figure 15D:
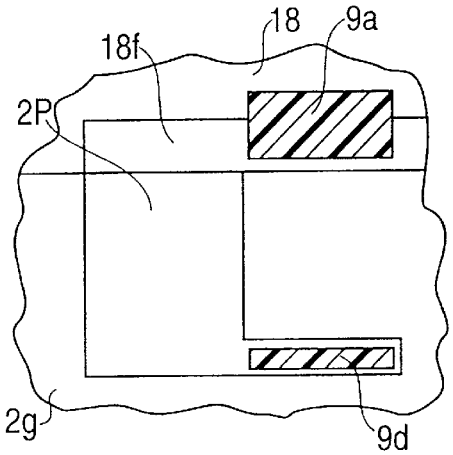
Figure 16C:
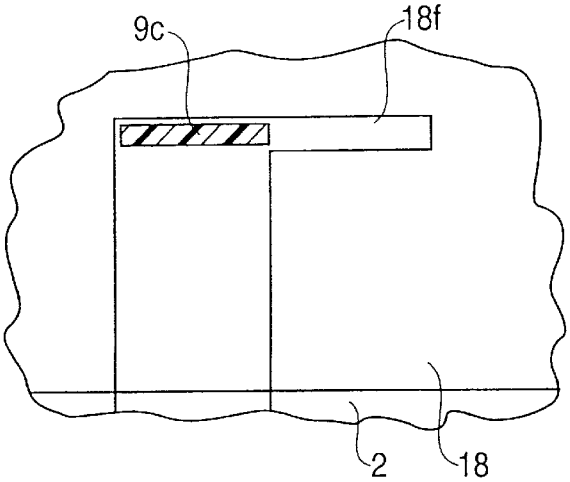
Figure 16D:
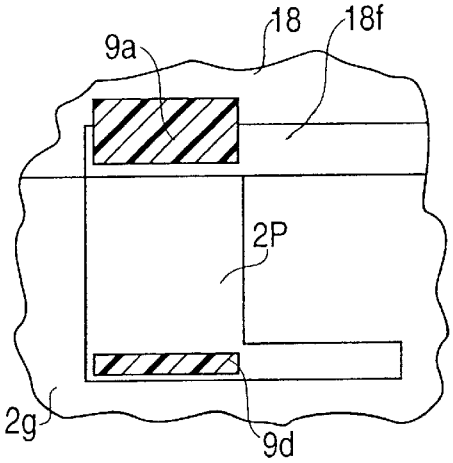
Figure 17A:
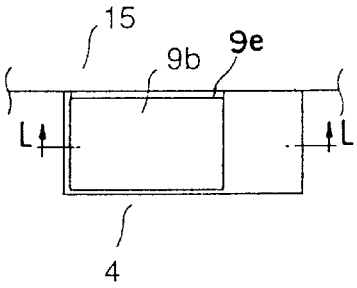
FIGS. 17A, 17B, 17C and 17D are a plan view and vertical cross sections showing a retained state of the retaining mechanism for the suction opening cover of the body of the cordless vacuum cleaner shown in FIG. 1, with FIG. 17B being taken along line L—L in FIG. 17A, FIG. 17C being taken along line M—M in FIG. 17B, and FIG. 17D being taken along line N—N in FIG. 17B.
Figure 17B:
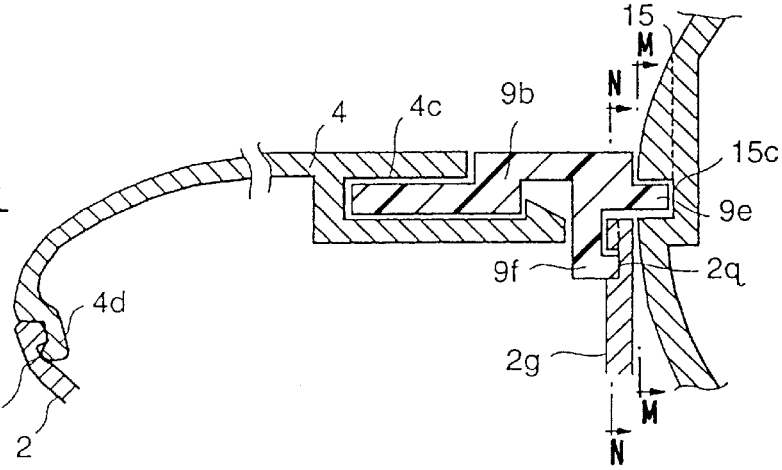
Figure 18A:
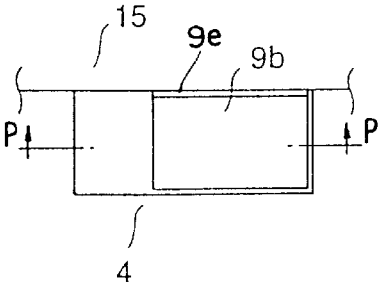
FIGS. 18A, 18B, 18C, and 18D are a plan view and vertical cross sections showing a released state of the retaining mechanism for the suction opening cover of the body of the cordless vacuum cleaner shown in FIG. 1, with FIG. 18B being taken along line P—P FIG. 18A, FIG. 18C being taken along line Q—Q in FIG. 18B, and FIG. 18D being taken along line R—R in FIG. 18B.
Figure 18B:
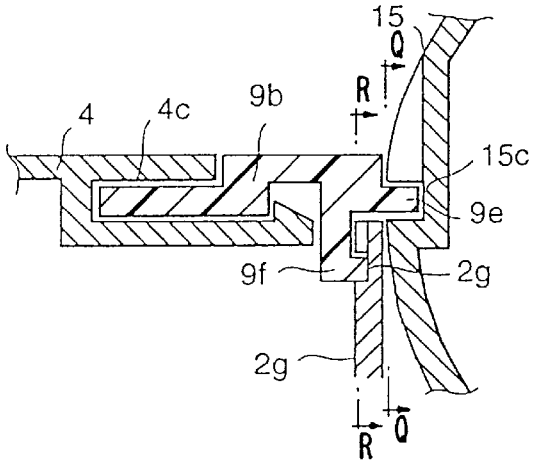
Figure 17C:
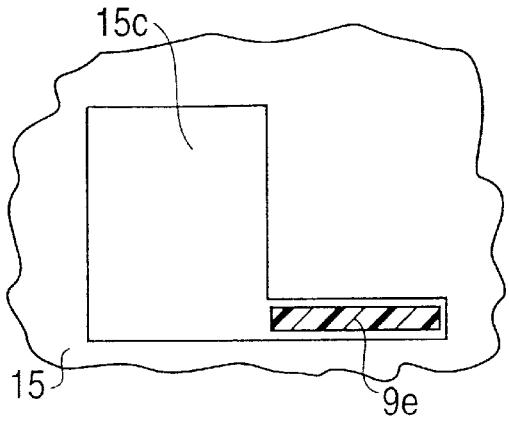
Figure 17D:
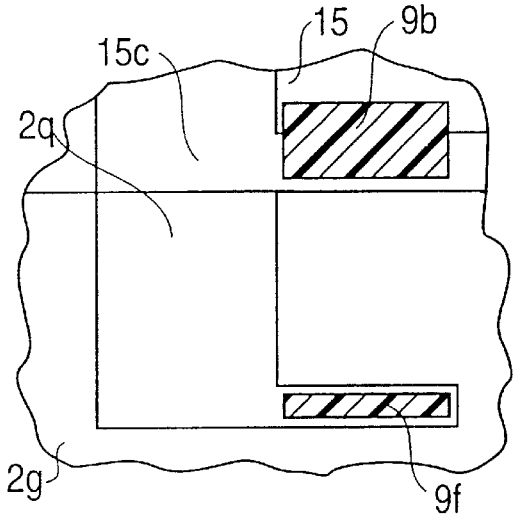
Figure 18C:
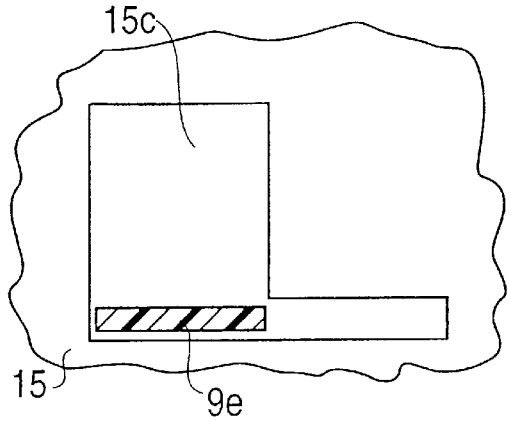
Figure 18D:
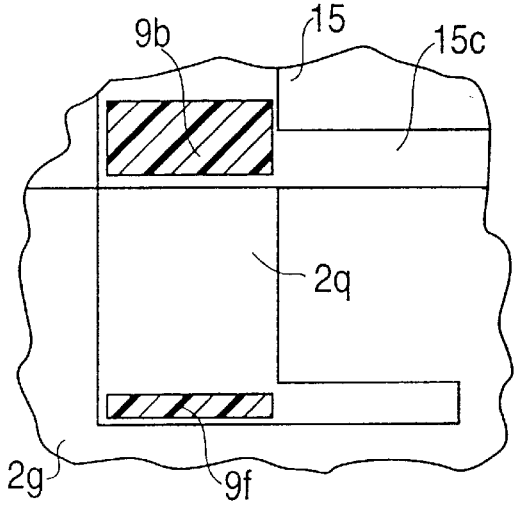

As seen in FIGS. 15C and 15D, retaining groove 18*f* has an inverted L shape, and retaining groove 2*p* has an L shape. When the control knob 9*a* is positioned in a retaining state, as shown in FIG. 15, the retaining portions 9*c* and 9*d* are retained in positions in which movement in the vertical direction is prevented so as to retain the dust collecting box 18 and the suction opening cover 4 closed. When the control knob 9*a* is moved to a released state, as shown in FIG. 16, the retaining portions 9*c* and 9*d* are moved to positions in which movement in the vertical direction is possible so as to release the dust collecting box 18 and the suction opening cover 4.

As shown in FIGS. 17 and 18, the control knob 9*b* is positioned in the guiding groove 4*c* at the rear end of the suction opening cover 4 so as to be slidable in the width direction. A retaining portion 9*e*, extending toward the electric blower unit cover 15, is positioned in a retaining groove 15*c* formed in a side face of the electric blower unit cover 15. A retaining portion 9*f*, extending downward, is positioned in a retaining groove 2*q* formed in the partition wall 2*g*. An engagement portion 4*d* is formed at the front end of the suction opening cover 4 and is positioned in an engagement groove 2*r* formed at the front end of the suction opening casing 2.

Each of the retaining grooves 15*c* and 2*q* has an L shape. When the control knob 9*b* is in the retained state, as shown in FIG. 17, the retaining portions 9*e* and 9*f* are retained in positions in which movement in the vertical direction is prevented so as to retain the suction opening cover 4 closed. When the control knob 9*b* is moved to a released state, as shown in FIG. 18, the retaining portions 9*e* and 9*f* are moved to positions in which movement in the vertical direction is possible so as to release the suction opening cover 4.

Figure 19B:
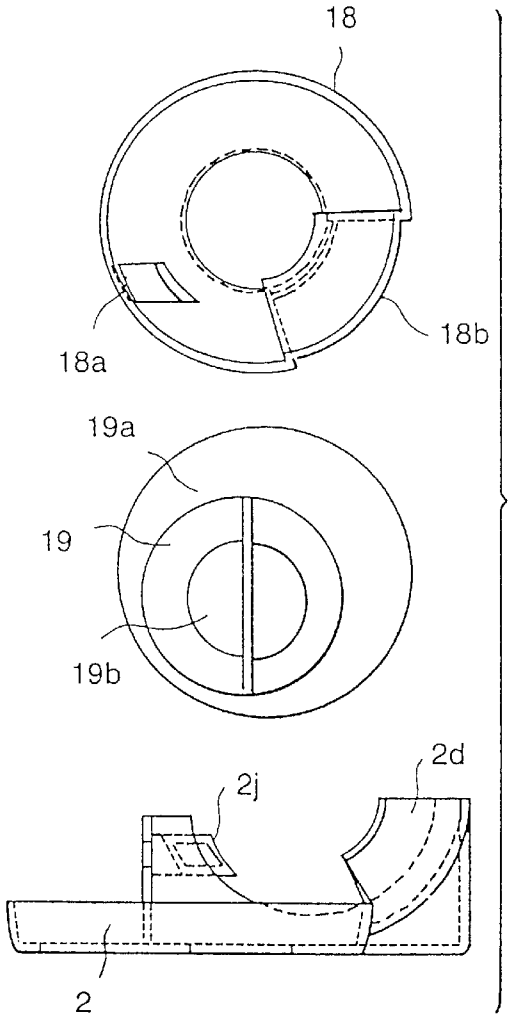
FIGS. 19A and 19B are an exploded back view and a side view of the dust collecting unit in the body of the cordless vacuum cleaner shown in FIG. 1.
Figure 19A:
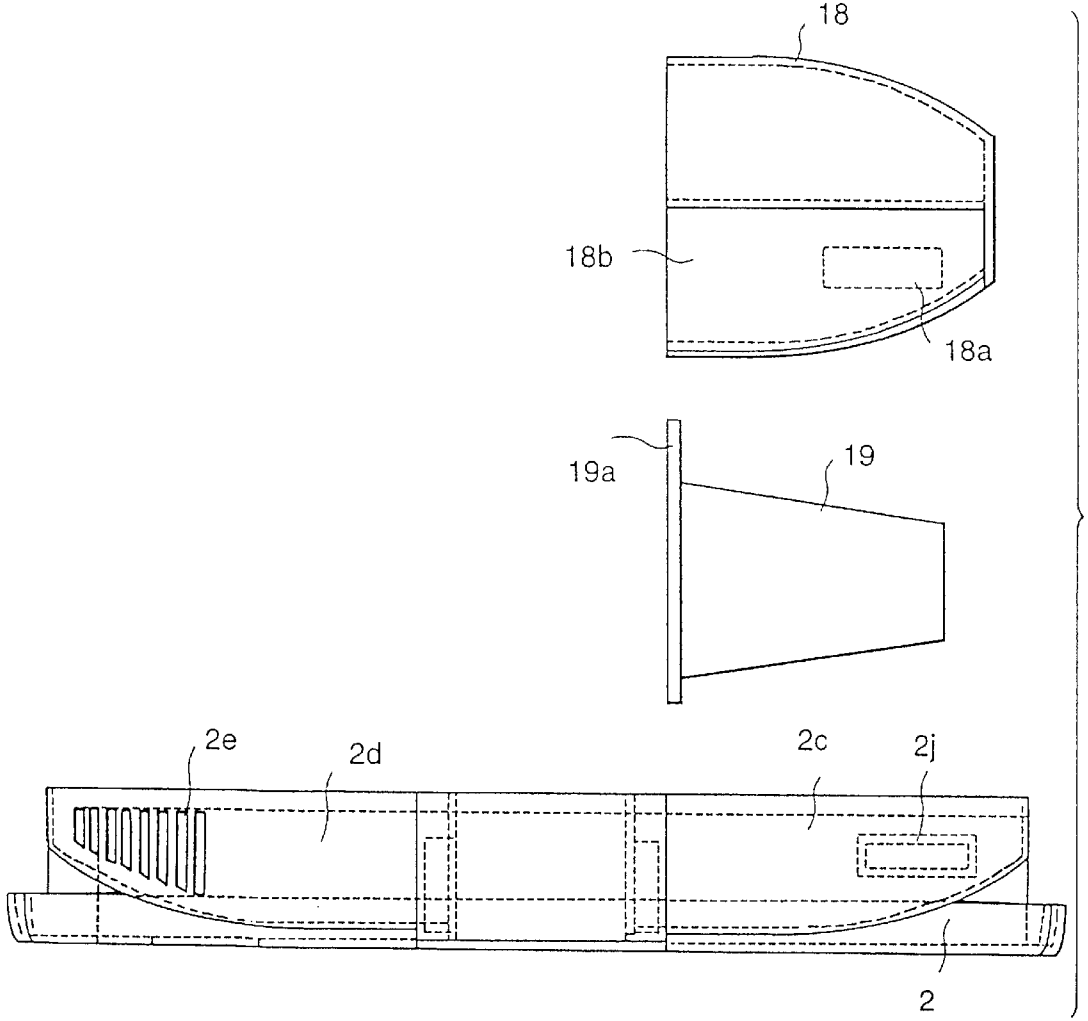

It is desirable to devise the dust collecting unit 6 so that dust collected by the dust collecting filter 19 set in the small dust collecting box 18 can be efficiently housed in the dust collecting box 18. FIG. 19A is an exploded back view of the dust collecting unit 6, and FIG. 19B is an exploded side view showing an embodiment in which the dust collecting filter 19 is positioned eccentrically in the dust collecting box 18.

In the embodiment, the dust collecting filter 19 is disposed eccentrically in the dust collecting box 18 so as to be close to the suction opening 18*a* in the dust collecting box 18. The upper portion of flange 19*a* in FIG. 19A extends from the main body of filter 19 a greater distance than does the lower portion of that flange. Thus, as seen from the middle drawing of FIG. 19B, the main body 19*b* of filter 19 is offset or eccentrically positioned when filter 19 is placed in dust collecting box 18. By this arrangement, the forward space of the dust collecting filter 19 in the dust collecting box 18 is narrowed and the rearward space is widened. The arrangement facilitates the air which contains dust flowing in at high speed from the suction opening 18*a* to the rear space of the dust collecting filter 19. The collected dust is accumulated from the rear of filter 19, so that a large amount of dust can be housed in the dust collecting box 18.

Alternatively, when the dust collecting filter 19 is positioned eccentrically so as to be apart from the suction opening 18*a*, the forward space of the dust collecting filter 19 becomes wider and the rear space becomes narrow. The speed of the air which contains dust flowing in from the suction opening 18*a* at high speed is reduced in the forward portion of the dust collecting filter 19, and the dust is collected and accumulated in the wide forward space. In this manner as well, a large amount of dust can be housed in the dust collecting box 18.

When the dust collecting filter 19 is positioned eccentrically to either of the sides, dust can be efficiently accumulated in the space in the dust collecting box 18.

Figures 20A, 20B, 20C, 20D:
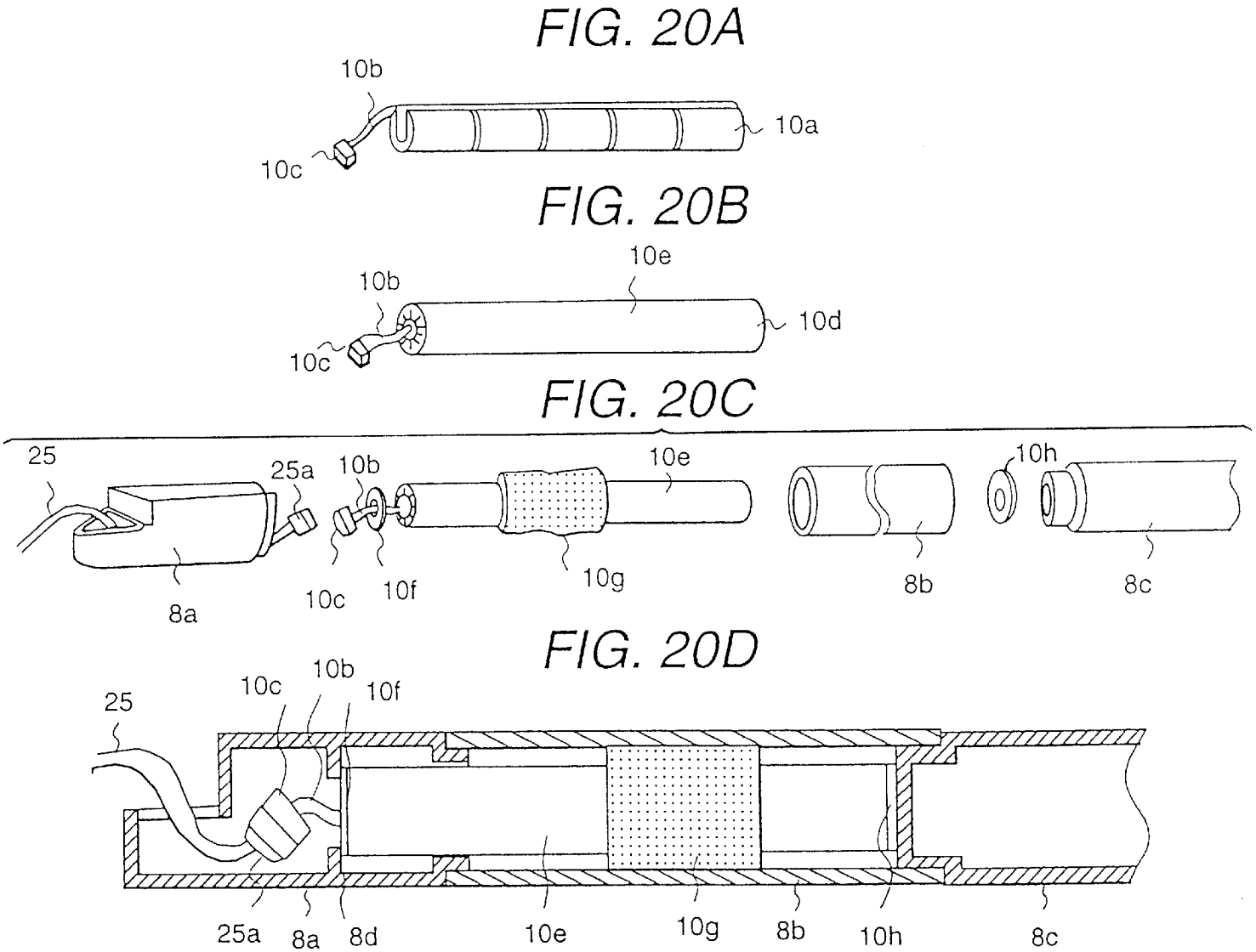
FIGS. 20A to 20D show the structure for housing a power supply unit in the handle of the cordless vacuum cleaner shown in FIG. 1.

FIGS. 20A to 20D show the structure of the housing for the power supply unit 10 in the handle 8. As shown in FIG. 20A, five batteries (cylindrical gaslight nickel-cadmium batteries) 10*a* are arranged in series, a connector 10*c* is connected to the tip of a lead wire 10*b*. As shown in FIG. 20B, the batteries 10*a* and the lead wire 10*b* are covered with a heat contraction tube 10*d* and so are integrated as a battery composite rod member 10*e*, while the lead wire 10*b* and the connector 10*c* extend from one end of member 10*e* and are exposed.

As shown in FIGS. 20C and 20D, the handle 8 is comprised of three hollow members made up of a joint member 8*a*, a power supply housing cylindrical member 8*b* and a holding member 8*c*. The members are coupled by screws and are locked by set screws.

A protection packing 10*f* is attached to the end face on the joint side of the battery composite rodlike member 10*e*. An arbitrary number of backlash preventing packings 10*g*, elastically formed by using a foamed resin, are attached around the battery composite rod member 10*e*. The connector 10*c* is connected to a connector 25*a* on the end of a lead wire 25 extending from the joint member 8*a*. The joint member side of the battery composite rod member 10*e* is inserted into the joint member 8*a* so that the end comes into contact with the step 8*d* in the joint member 8*a* via the protection packing 10*f*.

Then while compressing the backlash preventing packing 10*g*, the power supply housing cylindrical member 8*b* is positioned to enclose the battery composite rod member 10*e*. The end of the member 8*b* is connected to the joint member 8*a* by a screw. In such a state, the outer end of the battery composite rod member 10*e* is positioned in the screw connecting portion of the outer end of the power supply unit housing member 8*b*.

A protection packing 10*h* comes into contact with the outer end of the battery composite rod member 10*e*, and the battery composite rod member 10*e* is enclosed by pressing the outer end of the member 10*e*, via the protection packing 10*h*, with the inner end of the holding member 8*c* which is screwed to the outer end of the power supply housing cylindrical member 8*b*.

A wire (not shown) from the control switch 11, provided in the holding member 8*c*, is also connected to the vacuum cleaner body 1 through the hollow section.

The power is supplied from the power supply unit 10 to the driving motor 21 by interposing the control switch 11 and the responding switch 13*b* in the safety switch 13 in series. When the suction opening casing 2 lifts from the floor, the responding switch 13*b* is opened to check the power supply.

In the vacuum cleaner constructed as mentioned above, by allowing the bottom face of the suction opening casing 2 of the vacuum cleaner body 1 to come into contact with the floor while holding the handle 8, the responding lever 13*a* of the safety switch 13 is pressed against the floor and is retracted. Consequently, the responding switch 13*b* is closed, and power is supplied to the driving motor 21.

When the driving motor 21 rotates, the centrifugal fan 22 is driven, and an attraction force occurs in the centrifugal fan 22. The attraction force acts on the brush chamber 2*a* via the ventilating air communication passage 17, dust collecting box 18 and suction duct 2*j*. (FIG. 8) The air in the brush chamber 2*a* is sucked into the dust collecting box 18 via the suction duct 2*j*. Since the rotation of the driving motor 21 makes the rotating brush 3 rotate via the belt 23, the rotating brush 3 slides on the floor to thereby stir up the dust on the floor. The risen dust is sucked with air into the dust collecting box 18 via the suction duct 2*j* and collected.

As the vacuum cleaner body 1 moves on the floor, the sliding members 12*a* to 12*d* on the bottom face of the suction opening casing 2 and the front end face of the responding lever 13*a* slide on the floor so as to reduce the frictional force (resistance to sliding). (FIGS. 5, 6) Since the resistance to sliding of the sliding members 12*a* to 12*e* due to raising a fiber material is small as compared with the wheels, the travel in the travel direction and the lateral direction is easy. The tips of the pressure leakage preventing members 14*a* and 14*b* slide while being in contact with the floor. Consequently, the flow of air from the outside into the brush chamber 2*a* is suppressed to increase the vacuum in the brush chamber 2*a*, thereby enabling dust to be efficiently sucked.

At this time, since the weight of the power supply unit 10 in the handle 8 acts on the center portion of the suction opening casing 2 via the handle 8 and the handle joint 5, the offset load of the suction opening casing 2 is small and sliding travel is stable.

The vacuum cleaner travels, generally, with the bottom face of the suction opening casing 2 parallel with the floor. When an imbalance in operational force or resistance to sliding occurs, however, the travel becomes unstable and the vacuum cleaner body 1 is inclined and lifted. The bottom face of the suction opening casing 2 is therefore temporarily inclined and lifted. When the responding lever 13*a* of the safety switch 13 is in the position where the suction opening casing 2 is lifted, the responding lever 13*b* operates easily. In the vacuum cleaner body 1, the responding lever 13*a* is exposed below the driving motor 21 which is a heavy part and does not easily lift. Consequently, by reducing the operation by a temporary slight lifting of the suction opening casing 2 in an unstable travel state, the driving motor 21 can be stably driven.

According to the embodiment as described above, by the arrangement of the components, a small, easy-to-use, high-performance vacuum cleaner can be provided.

Since the dust collecting box and the suction opening cover are retained/released by providing the suction opening cover with the control knobs of the retaining mechanism, the dust collecting box and the suction opening cover can be easily attached/detached, so that discard of the collected dust and cleaning of the rotating brush are facilitated.

Due to the attaching/detaching face of the dust collecting box, the loss of air tightness in the air duct can be prevented.

The dust collecting filter is eccentrically provided in the dust collecting box, thereby increasing the capacity for collected dust.

By providing the handle joint between the dust collecting unit and the electric blower unit which are arranged in the lateral direction on the suction opening casing, the vacuum cleaner having a good weight balance is obtained.

According to the invention, the rodlike handle connected to the vacuum cleaner body is constructed as a hollow member. A plurality of batteries are arranged in series in the hollow member. The batteries are therefore efficiently housed.

The plurality of batteries are covered with the heat contraction tube so as to be integrated in a rod shape and housed in the hollow rod, thereby improving the assembling performance.

An arbitrary number of backlash preventing packings which are elastically formed by using a foamed resin are interposed between the rod member and the hollow member, and the outer ends of the plurality of batteries which are arranged in series are pressed via the protection packings. Thus, the batteries are prevented from rattling in the handle.

The dust collecting unit and the electric blower unit are arranged in the lateral direction on the back side of the brush chamber in the suction opening casing. The dust collecting unit and the electric blower unit are connected via the communication passage, and the handle joint is provided so as to surround the communication passage. The rodlike handle is connected to the handle joint. Consequently, the operation is prevented from becoming unstable due to the weight of the batteries.

Another embodiment according to the invention will now be described. The following embodiment of the invention mainly relates to the electric blower. An object of the embodiment is to provide a small, light, and highly-efficient electric blower in a vacuum cleaner, including an electric motor and a blower and a dust collecting unit. In other words, the object is to provide a small, light vacuum cleaner having a high dust collecting performance.

The other embodiment of the invention will be described herein below with reference to FIGS. 21 to 31. In the embodiment, the side in which is formed an opening of a brush chamber which faces the floor when the suction opening member is disposed on the floor, that is, the face to be cleaned, is defined as the lower side or under side. The side opposite to the lower side is defined as the upper side or top side. In the embodiment, it is assumed that air sucked in the axial direction of an axial impeller flows conically around the rotary shaft in the impeller, the meridian plane of the impeller is inclined with respect to the rotary shaft, and the outer diameter on the shroud side of the impeller is larger than that on the hub side.

Figure 21:
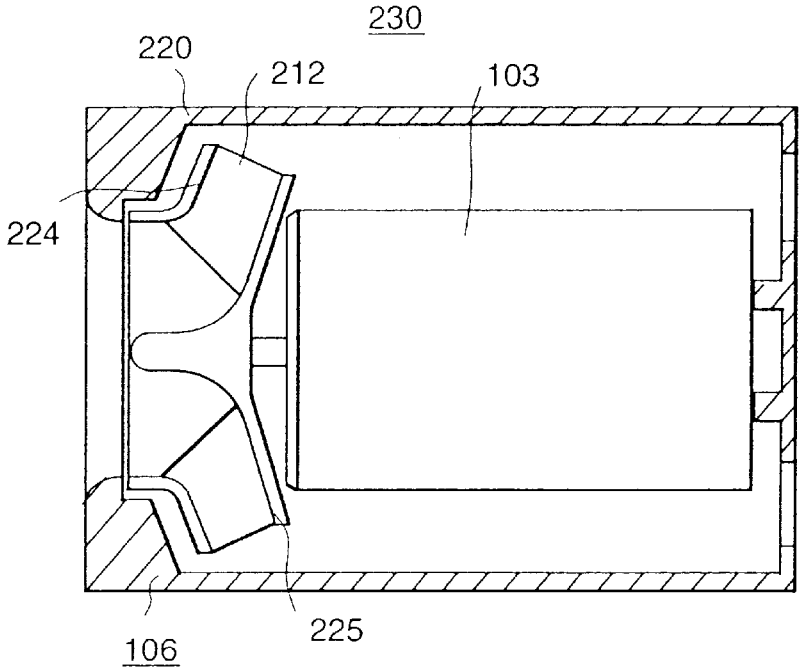
FIG. 21 is a cross section of an electric blower according to an example of the invention.
Figure 30:
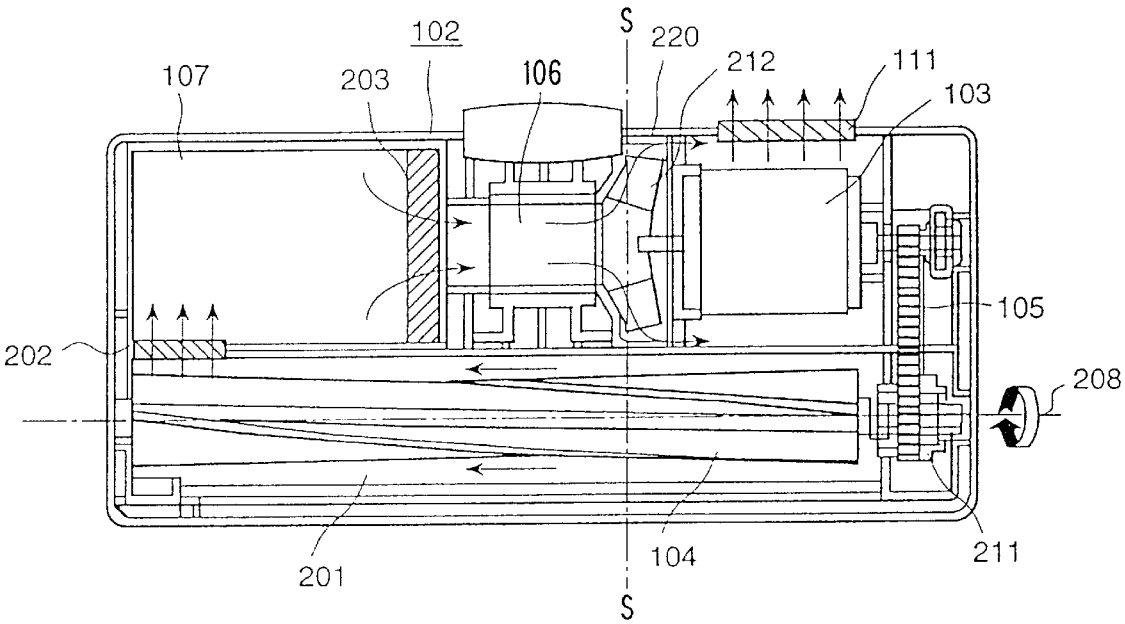
FIG. 30 is a cross section of the suction opening casing of the vacuum cleaner according to an embodiment of the invention as seen from overhead.

First, an example of the embodiment of the invention will be described with reference to FIGS. 21 and 30. FIG. 21 is a cross section of an electric blower as an example of the embodiment of the invention. FIG. 30 is a cross section when a suction opening casing 102 of a vacuum cleaner of an example of the embodiment of the invention is seen from overhead.

The flow of the air and dust in the suction opening member will be described with reference to FIG. 30. A brush chamber 201 has an opening facing the floor. The air and dust sucked from the opening pass through a suction opening 202 connecting the brush chamber 201 and a dust collecting unit 107 and enter the dust collecting unit 107. A filter 203 is provided on the exhaust side of the dust collecting unit 107. The mixture of the air and dust is separated into the air and dust by the filter 203, and the dust is accumulated in the dust collecting unit 107. The air passes through the filter 203, the pressure of the air is increased by an impeller 212 of a blower 106, the air is directed by the inner radius side of a blower casing 220, covering the impeller 212, and cools an electric motor 103. After that, the air is exhausted from an exhaust port 111 to the outside of the suction opening casing 102. The arrows in the diagram represent the flow of air.

As shown in FIG. 30, the dust collecting unit 107, the impeller 212 of the blower 106, and the electric motor 103 are arranged almost in parallel with a rotary shaft 208 of a rotating brush 104. As described above, the dust collecting unit 107, the blower 106, and the electric motor 103 are arranged on an almost straight line.

In a vacuum cleaner 100 as described above, the passage from the brush chamber 201 to the blower 106 is short, so that the ventilating air loss is reduced. As a result, the blower 106 needs, rather than the pressure performance, a flow rate (volume of air) performance in order to draw dust to the dust collecting unit 107.

It is preferable to set the rotational speed of the rotary brush 104 up to around 4,000 rpm so as not to damage the flooring material. The maximum reduction ratio from the rotational speed of the electric motor 103 is about 3.7. In the embodiment, since the blower 106 and the rotating brush 104 are driven by the single electric motor 103, the rotational speed of the blower 106 is within about plus or minus 1,000 of 14,000 rpm.

In the case where the inner diameter of the blower casing 220 of the blower 106 is about 70 mm and the flow rate is about 0.6 $m^3$/min, dust rises when the pressure is about 70 mmAq. Consequently, the specific speed of the blower 106, expressed by equation 1, ranges from about 450 to 550. As a result, as shown in FIG. 21, by using a mixed flow impeller 212 in the blower 106, high efficiency of the blower 106 is obtained, the blower 106 can be miniaturized, and the vacuum cleaner 100 can be accordingly miniaturized.

$$N_s = \frac{NQ^{0.5}}{H^{0.75}} \qquad \text{(Equation 1)}$$

where, N: rotational speed (rpm), Q: flow rate ($m^3$/min), and H: lift (m).

By using the structure shown in FIG. 21, air flowed from the impeller 212 can be used to cool the electric motor 103. It is therefore unnecessary to provide a fan or the like to cool the electric motor 103, the electric blower 230 can be miniaturized, and the vacuum cleaner 100 itself can be accordingly miniaturized.

Figure 22:
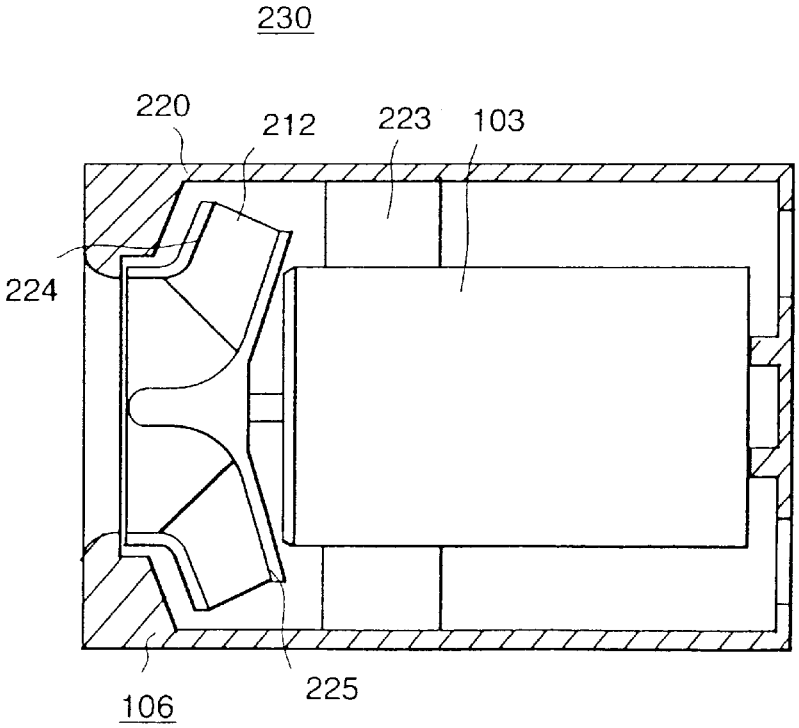
FIG. 22 is a cross section of an electric blower according to an example of the invention.

An example of another embodiment of the invention will now be described with reference to FIG. 22. FIG. 22 shows the structure with the mixed flow impeller 212 directly connected to the electric motor 103 and with an axial diffuser 223 on the downstream side of the impeller 212.

In the embodiment, by using the blower 106 having the above structure, dynamic pressure of air flowing from the impeller 212 is recovered by the diffuser 223 as a static pressure, the speed of the air is reduced and, after that, the electric motor 103 is cooled. The frictional loss is therefore reduced, and the efficiency of the electric blower 230 is improved. Consequently, the size of the blower casing 220 is reduced, and the space between the blower casing 220 and the electric motor 103 can be reduced, so that the electric blower 230 can be accordingly miniaturized.

Figure 23:
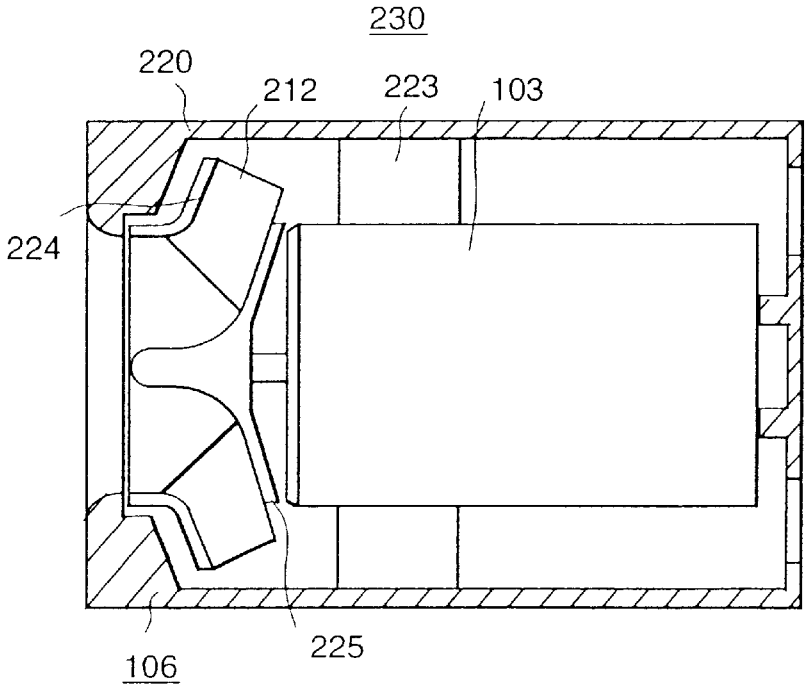
FIG. 23 is a cross section of an electric blower according to an example of the invention.

Referring now to FIG. 23, an example of another embodiment of the invention will be described. The mixed flow impeller 212 is directly connected to the electric motor 103, the axial diffuser 223 is disposed downstream of the impeller 212, a side plate of a hub 225 of the impeller 212 is made smaller than the blade outlet diameter on the hub 225 side of the impeller 212.

Generally, the flow of air in the mixed flow impeller is directed to the hub 225 side when the volume of air is high, and the speed in the axial direction of the flow increases. The above structure prevents air flowing from the outlet of the hub 225 side of the impeller 212 from being choked, so that the efficiency of the blower 106 on a large volume side is improved. Since the length of the blade is long, the flow is restricted by the blade on a small volume side. Consequently, deterioration in work of the impeller due to sliding can be also prevented.

As a result, the gap between the outlet of the impeller 212 and the blower casing 220 can be narrowed, so that the blower 230 can be miniaturized.

Further, when the volume of air of the impeller 212 is high, the load on the electric motor 103 increases, and the temperature of the electric motor 103 increases. In this case, since the air from the impeller 212 flows near the impeller 212 side of the electric motor 103, the electric motor 103 is effectively cooled.

Figure 24:
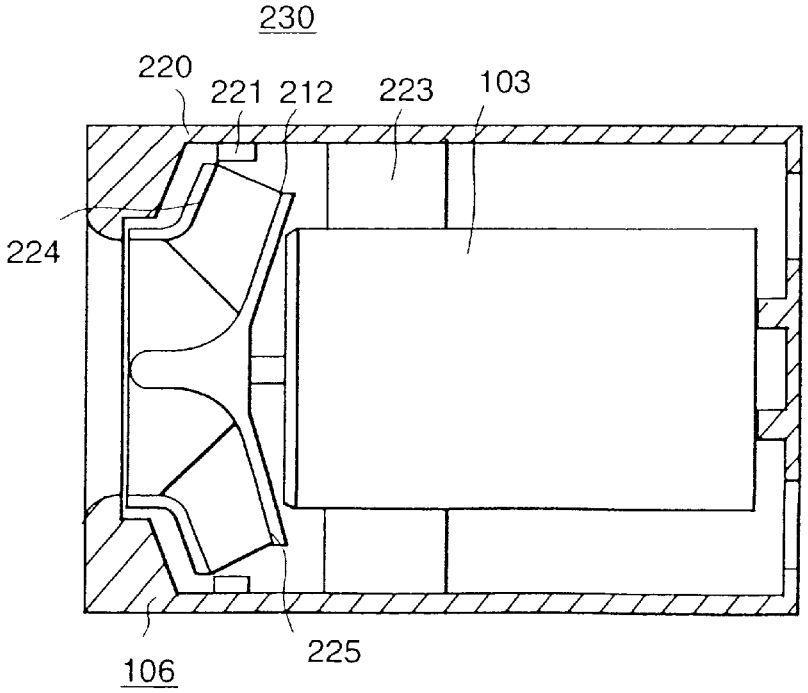
FIG. 24 is a cross section of an electric blower according to an example of the invention.
Figure 25:
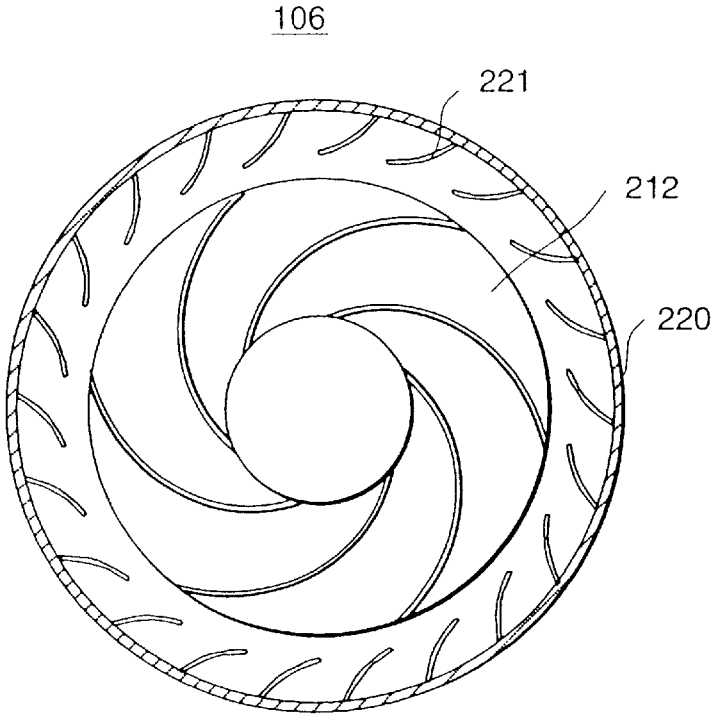
FIG. 25 is a cross section of an electric blower according to an example of the invention.
Figure 26:
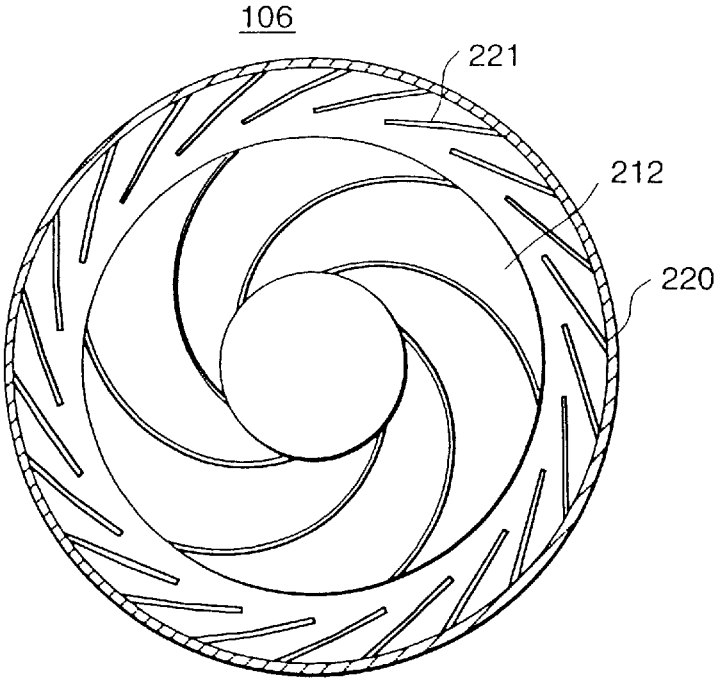
FIG. 26 is a cross section of an electric blower according to an example of the invention.

An example of another embodiment of the invention will be described with reference to FIGS. 24 to 26. FIG. 24 is a cross section of an electric blower according to this embodiment of the invention. FIG. 25 is a cross section of a blower according to the embodiment of the invention. FIG. 26 is a cross section of a blower according to the example of the embodiment of the invention.

In the embodiment, the mixed flow impeller 212 is directly connected to the electric motor 103 and the axial diffuser 223 is provided downstream of the impeller 212. Around the impeller 212, a circular or linear guide plate 221 is disposed upstream of the diffuser 223.

The flow of air in the mixed flow impeller 212 is directed to the hub 225 side when the volume of air is high and the flow is deviated in the axial direction. By providing the axial diffuser 223 downstream of the impeller 212, the dynamic pressure of the flow of air from the impeller 212 can be recovered as a static pressure, so that the efficiency of the blower 106 on a high air volume side is improved. The frictional loss in the case of cooling the electric motor 103 can be also reduced. The flow of air in the axial impeller 212 is directed to a shroud 224 side when the air volume is low. It is therefore important to smoothly change a turning component of the flow of air from the impeller 212 to the rotational axis direction of the impeller 212.

In the embodiment, the circular or linear guide plate 221 is provided upstream of the diffuser 223 around the impeller 212. The turning component of the flow of air from the impeller 212 is converted into a component in the rotational axial direction of the impeller 212, so that the frictional loss when the air flows in the space between the impeller 212 and the blower casing 220 is reduced. As a result, also on the low air volume side, the turning component of the flow of air from the impeller 212 can be changed to a component in the rotational axis direction of the impeller 212, so that the turning component of air for cooling the electric motor 103 is reduced, the frictional loss is reduced, and the efficiency of the electric blower 230 is improved.

Further, since the turning component of the flow of air from the impeller 212 can be smoothly changed to the component in the rotational axis direction of the impeller 212, the diameter of the blower casing 220 can be reduced, the size and weight of the electric blower 230 constructed by the blower 106 and the electric motor 103 can be reduced, and the small and light vacuum cleaner can be therefore realized.

It is preferable to attach the guide plate 221 around the axial position on the shroud 224 side of the outlet of the impeller 212. Further, by making the length in the rotation axial direction of the impeller 212 of the guide plate 221 shorter than that of the above impeller, a loss caused by blockage on the high air volume side can be reduced.

In the vacuum cleaner, in a state where dust is accumulated in the dust collecting unit 107, the air volume of the blower 106 becomes low. In order to attract dust, the head of the blower is necessary. Further, when only a small amount of dust is accumulated in the dust collecting unit 107, the air volume of the blower 106 becomes high. A high flow rate performance of the blower is necessary to attract dust. As a result, the mixed flow impeller 212 and the axial diffuser 223 are disposed downstream of the impeller 212 as shown in FIG. 23. By combining the structure such that the side plate of the hub 225 of the impeller 212 is formed smaller than the diameter of the outlet of the blade on the hub 225 side of the impeller and the structure shown in FIGS. 24 to 26 that the mixed flow impeller 212 and the axial diffuser 223 downstream of the impeller 212 are disposed and the circular or linear guide plate 221 is disposed upstream of the diffuser 223 around the impeller 212, dust can be effectively attracted when dust is accumulated in the dust collecting unit 107 and when only a small amount of dust is collected in the dust collecting unit 107.

Figure 27:
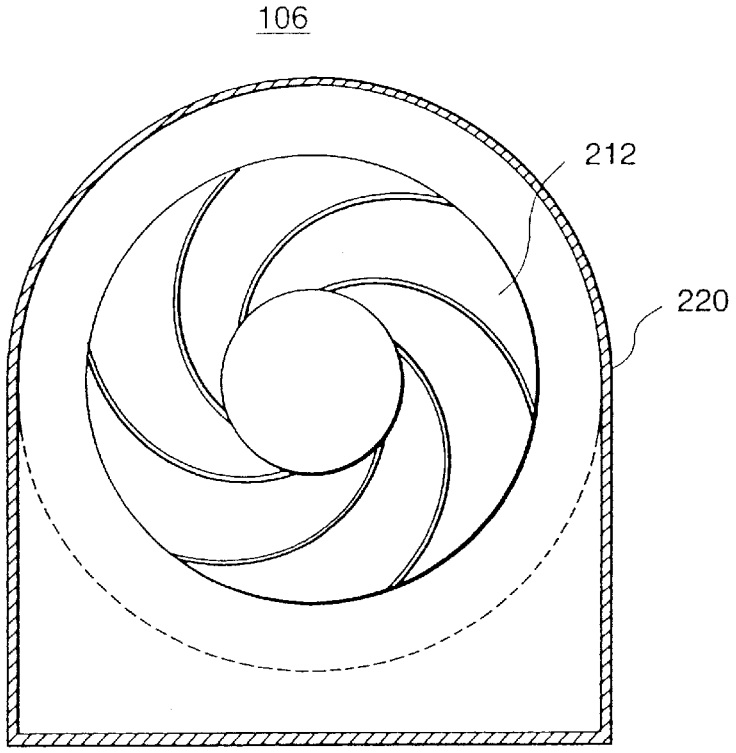
FIG. 27 is a cross section of an electric blower according to an example of the invention.
Figure 28:
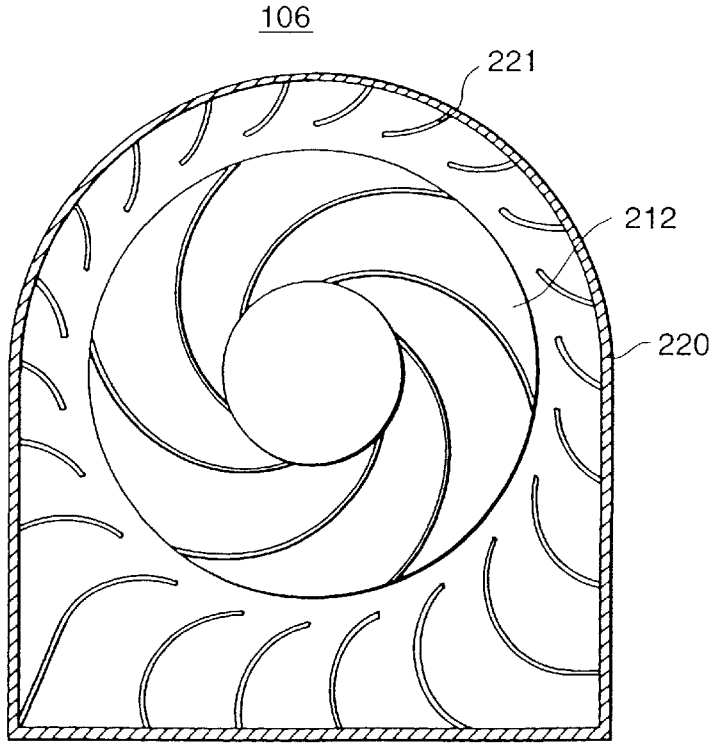
FIG. 28 is a cross section of an electric blower according to an example of the invention.
Figure 31:
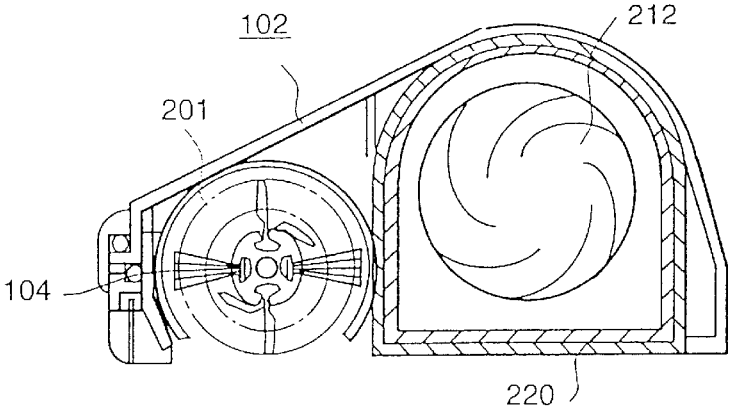
FIG. 31 is a cross section taken along line S—S of FIG. 30.

An example of another embodiment of the invention will be described with reference to FIGS. 27, 28, 30, and 31. FIG. 27 is a cross section of a blower according to an embodiment of the invention. FIG. 28 is a cross section of a blower according to an embodiment of the invention. FIG. 30 is a cross section of the vacuum cleaner as seen from overhead. FIG. 31 is a cross section taken along line F—F of FIG. 30.

As shown in FIG. 27, in the embodiment, the blower casing 220 has a shape obtained by combining circular and rectangular shapes, and a structure such that the top face side has a circular shape and the under face side has a rectangular shape is used. As shown in FIG. 31, the under face side of the suction opening casing 102 is disposed so as to be parallel with the floor face and in contact with the floor in order to increase the air tightness of the brush chamber 201.

According to the embodiment, the blower casing 220 has the above structure and the dead space in the suction opening casing 102 can be utilized. Consequently, the suction opening base 102 can be made small and light. The vacuum cleaner can be accordingly made small and light.

Further, since the space formed between the impeller 212 and the blower casing 220 can be enlarged without increasing the size of the suction opening casing 102, the speed of the air caused to flow by the impeller 212 is reduced, the air can be exhausted from the exhaust port 111 (FIG. 30), the dynamic pressure of air which becomes a loss at the time of exhaust can be reduced, and the loss can be therefore reduced. Since the speed of air caused to flow by from the impeller 212 at the time of exhaust can be reduced, the frictional loss of air for cooling the electric motor 103 can be also reduced.

Further, as shown in FIG. 28, by disposing the circular or linear guide plates 221 on the upstream side of the diffuser 223 around the impeller 212, the turning component of the flow can be recovered as a static pressure more effectively. At this time, the rotary shaft of the impeller 212 of the blower 106 can be disposed to the side to be cleaned with respect to the center of the circular portion of the blower casing 220.

Figure 29:
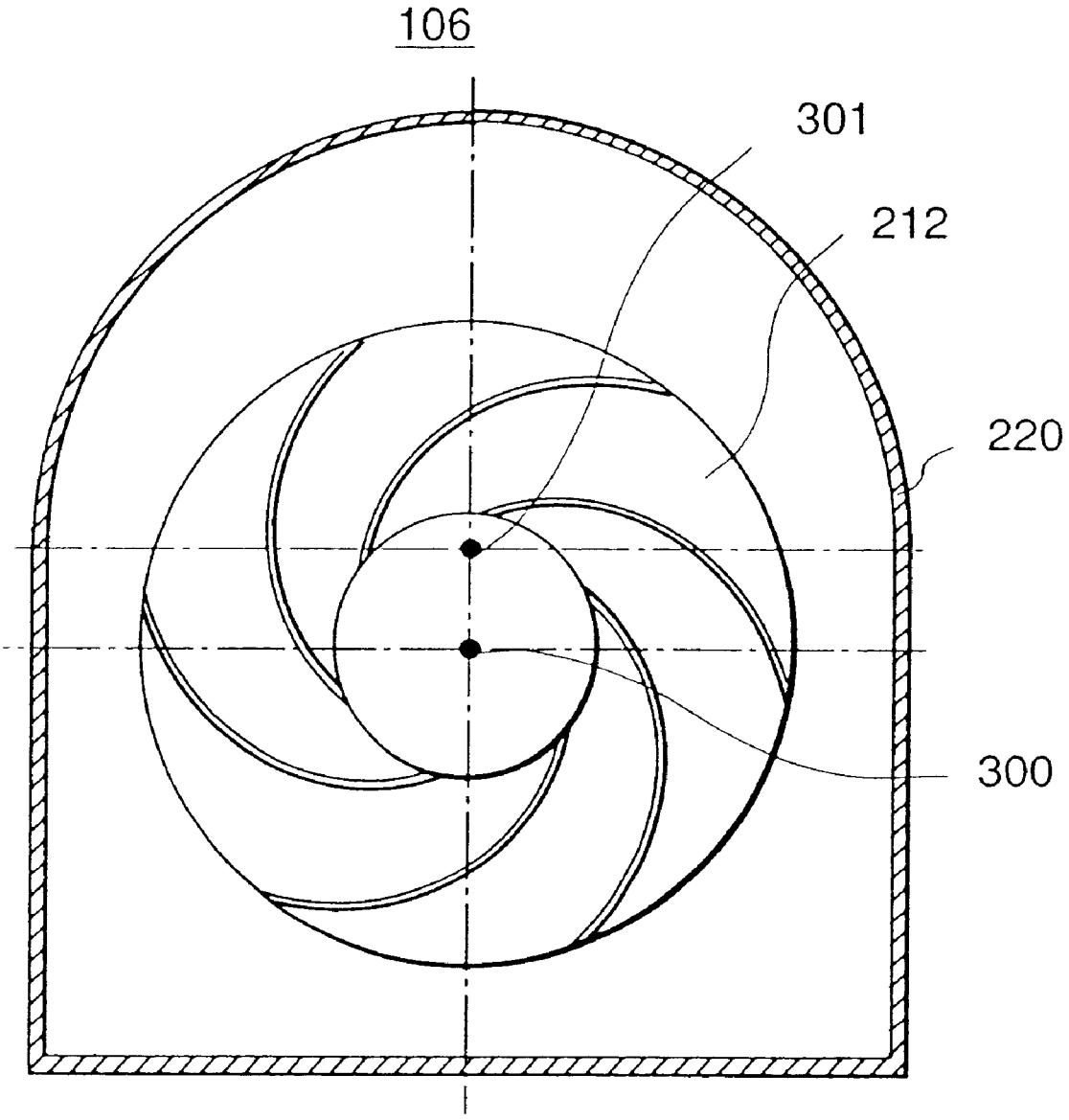
FIG. 29 is a cross section of an electric blower according to an example of the invention.

FIG. 29 is a cross section of the blower according to another embodiment of the invention. As shown in FIG. 29, the blower casing 220 has a shape obtained by combining the circle and rectangle, the top face side is formed in a circular shape, the under face side is formed in a rectangular shape, and the rotary shaft 300 of the impeller 212 of the blower 106 is disposed toward the surface to be cleaned with respect to the center position 301 of the circular portion of the blower casing 220.

In the embodiment, a plurality of volute-shaped spaces are formed, the dynamic pressure of the air caused to flow by the impeller 212 is recovered as a static pressure, and the loss of the blower is reduced. Further, since the turning component of the flow of the air caused to flow by the impeller 212 can be reduced, the turning component of the air for cooling the electric motor 103 can be decreased and the frictional loss can be therefore reduced.

According to the embodiment as described above, the blower can be miniaturized and the size of the vacuum cleaner can be accordingly reduced.

Since the speed of the air flowed from the impeller at the time of exhaust can be also reduced, the frictional loss of air for cooling the electric motor can be also reduced. Further, the turning component of the flow of the air flowed from the impeller can be smoothly changed to the rotation axis direction of the impeller. Consequently, the frictional loss when the air flows in the space between the impeller and the blower casing can be reduced.

The air flowing from the outlet on the hub side of the impeller can also be prevented from being choked, so that the efficiency of the blower on the high air volume side can be improved. Since the blade can be made long and the flow is restricted by the blade on the low air volume side, the deterioration of work of the impeller due to sliding can also be prevented. When the air volume of the impeller is high, the load on the electric motor increases and the temperature of the electric motor increases significantly. Since the air from the impeller, however, passes near the impeller side of the electric motor, the electric motor can be effectively cooled.

Since the space formed between the impeller and the blower casing can be made large without increasing the vacuum cleaner, the speed of the air flowing out from the impeller can be reduced, the air can be exhausted from the exhaust port, the dynamic pressure of the air which becomes a loss at the time of exhaust can be reduced, and the loss can be therefore reduced.

What is claimed is:

1. A vacuum cleaner comprising:

a vacuum cleaner body including a casing having therein a dust collecting unit, an electric blower unit and a brush chamber, with a brush rotatably mounted in the brush chamber;

a rodlike handle connected to the vacuum cleaner body and including a hollow member;

a plurality of batteries housed in series in the hollow member; and a heat contraction tube covering the plurality of batteries, integrating the batteries into a rodlike member.

2. The vacuum cleaner according to claim 1, further comprising a plurality of backlash preventing packings interposed between the rodlike member and the hollow member.

3. The vacuum cleaner according to claim 2, wherein the dust collecting box is cup-shaped.

4. The vacuum cleaner according to claim 2, wherein the backlash preventing packings are formed of a foamed resin.

5. The vacuum cleaner according to claim 4, wherein the backlash preventing packings are elastic.

6. A vacuum cleaner comprising:

a vacuum cleaner body including a casing having therein a dust collecting unit, an electric blower unit and a brush chamber, with a brush rotatably mounted in the brush chamber;

a rodlike handle connected to the vacuum cleaner body and including a hollow member;

a plurality of batteries housed in series in the hollow member; and a protection packing abutting the outer ends of the series plurality of batteries.

7. A vacuum cleaner comprising:

a vacuum cleaner body including a casing having therein a dust collecting unit, an electric blower unit and a brush chamber, with a brush rotatably mounted in the brush chamber;

a rodlike handle connected to the vacuum cleaner body and including a hollow member; and a plurality of batteries housed in series in the hollow member, wherein:

the dust collecting unit and the electric blower unit are arranged in a lateral direction behind the brush chamber in the casing and are connected to each other via a communication passage, said vacuum cleaner further comprises a handle joint surrounding the communication passage, and the rodlike handle is connected to the handle joint.

8. A vacuum cleaner comprising a casing having an opening adapted to face a surface to be cleaned, the casing having therein a dust collecting chamber, a blower, a rotary cleaning member, and an electric motor for driving the blower and the rotary cleaning member, wherein the blower has a mixed flow impeller.

9. A vacuum cleaner comprising a casing having an opening adapted to face a surface to be cleaned, the casing having therein a dust collecting chamber, an electric motor, a rotary cleaning member, a blower with an impeller, and a diffuser downstream of the impeller, wherein the blower and the rotary cleaning member are driven by the electric motor, and wherein the impeller of the blower is a mixed flow impeller and the diffuser is an axial diffuser.

10. A vacuum cleaner comprising a casing having an opening adapted to face a surface to be cleaned, the casing having therein a dust collecting chamber, an electric motor, an impeller coupled to the electric motor, a blower, and a diffuser disposed downstream of the impeller, wherein the impeller is a mixed flow impeller having a blade, a hub, and a hub side plate smaller than the diameter of the blade on the hub side of the impeller, and the diffuser is an axial diffuser.

11. A vacuum cleaner comprising a casing having an opening adapted to face a surface to be cleaned, the casing having therein a dust collecting chamber, an electric motor, an impeller coupled to the electric motor, a blower, a diffuser disposed downstream of the impeller, and a guide plate disposed upstream of the diffuser and around the impeller, wherein the impeller is a mixed flow impeller, and the diffuser is an axial diffuser.

12. The vacuum cleaner according to claim 11, further comprising a plate disposed in the circumferential direction around the impeller, and wherein the length of the plate in the rotary axis direction of the impeller is less than the length of the impeller in the rotary axis direction of the impeller.

13. The vacuum cleaner according to claim 12, wherein the plate is a circular plate.

14. The vacuum cleaner according to claim 12, wherein the plate is a linear plate.

15. A vacuum cleaner, comprising:

a casing having an interior and a pivotable handle joint;

a partition wall in the casing interior, the partition wall dividing the casing interior into a front portion and a rear portion, the front portion having therein a brush chamber with a casing suction opening, the rear portion having therein a dust collecting unit and a blower unit, with a communication passage defined through the handle joint in a direction substantially parallel with the partition wall, the communication passage coupling the dust collecting unit and the blower unit, the dust collecting unit having a dust collecting unit receiver provided at a rear end of the casing, the partition wall having a suction duct therethrough, and the casing including a cover covering the brush chamber and the casing suction opening;

a brush rotatably mounted in the brush chamber;

a blower in the blower unit;

a drive motor in the blower unit to drive the blower, the drive motor being coupled to the brush to rotate the brush;

a dust collecting box having a collecting box suction opening in a face thereof and having an opening end, the dust collecting box being detachably attached to the casing and supported within the dust collecting unit by the dust collecting unit receiver with the collecting box suction opening communicating through the suction duct with the brush chamber, the opening end communicating through the communication passage with the electric blower unit; and a dust collecting filter in the dust collecting box.

16. The vacuum cleaner according to claim 15, further comprising a retaining mechanism for retaining the dust collecting box and the suction opening cover together on the casing.

17. The vacuum cleaner according to claim 15, wherein the casing has a step, and the dust collecting unit has a step which comes into contact with the casing step, the dust collecting unit step being formed on the peripheral face of the dust collecting box in order to stabilize the dust collecting box when the dust collecting box is attached to the casing.

18. The vacuum cleaner according to claim 15 or 17 wherein the dust collecting box face is inclined and has a circular bottom with a small diameter, and the collecting box suction opening is fonned in the inclined face.

19. The vacuum cleaner according to claim 18, wherein the collecting box suction opening is formed in the lower half portion of the dust collecting box when the dust collecting box is attached to the casing.

20. The vacuum cleaner according to claim 15, wherein the dust collecting box is attachable and detachable within the dust collecting unit in a vertical direction, and the dust collecting box includes a packing attached to the dust collecting box opening end, the packing having an inclined face with a thick upper side and a thin and receding lower side, and wherein the communication passage has an end face formed as a flange with an inclined face having a thick lower side and a thin and receding upper side.

21. The vacuum cleaner according to claim 15, wherein the dust collecting filter is housed eccentrically in the dust collecting box.

22. The vacuum cleaner according to claim 21, wherein the dust collecting filter is close to the collecting box suction opening side of the dust collecting box.

23. The vacuum cleaner according to claim 21, wherein the dust collecting filter is remote from the collecting box suction opening side of the dust collecting box.

* * * * *